US006312534B1

(12) United States Patent
Grensing

(10) Patent No.: US 6,312,534 B1
(45) **Date of Patent: *Nov. 6, 2001**

(54) HIGH STRENGTH CAST ALUMINUM-BERYLLIUM ALLOYS CONTAINING MAGNESIUM

(75) Inventor: Fritz C. Grensing, Perrysburg, OH (US)

(73) Assignee: Brush Wellman, Inc., Cleveland, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/971,062

(22) Filed: Nov. 14, 1997

Related U.S. Application Data

(63) Continuation-in-part of application No. 08/937,274, filed on Sep. 15, 1997, now Pat. No. 6,042,658, which is a continuation of application No. 08/221,935, filed on Apr. 1, 1994, now Pat. No. 5,667,600.

(60) Provisional application No. 60/030,949, filed on Nov. 15, 1996.

(51) Int. Cl.[7] ..... C22C 21/00

(52) U.S. Cl. ..... 148/437; 360/106; 420/528; 420/529; 420/533; 420/542; 148/400

(58) Field of Search ..... 148/437, 400; 420/528, 529, 533, 542; 360/106

(56) References Cited

U.S. PATENT DOCUMENTS 1,254,987 * 1/1918 Cooper ..... 420/529
1,905,313 4/1933 Smith .
1,952,049 * 3/1934 Archer et al. ..... 420/528

(List continued on next page.)

FOREIGN PATENT DOCUMENTS 524882 2/1939 (GB) ..... 420/528
1198107 7/1970 (GB) .
1202129 8/1970 (GB) .
WO95/06760 3/1995 (WO) .
WO95/27088 10/1995 (WO) .

OTHER PUBLICATIONS

Robert Horton, "Investment Casting", ASM Metals Handbook (9th edition), Dec. 1988; vol. 15, pp. 264–265.
Murray et al., *Phase Diagrams of Binary Beryllium Alloys*, p. 9, Dec. 1987.
Boyer et al., *Aluminum Alloys*, Metals Handbook Desk Edition, Dec. 1985, pp. 6–24, 6–25 and 6–55.
Brown, A.S., *Bending Swords into Gold Clubs*, Aerospace America. Nov. 1993, pp. 18–22.
Horton, R.A., *Investment Casting*, Metals Handbook, Dec. 1988, 9th Edition, vol. 15, pp. 253 et seq.
Davis, G.J., *Solidification and Casting*, Dec. 1973, pp. 174–177.

(List continued on next page.)

*Primary Examiner*—Scott Kastler
(74) *Attorney, Agent, or Firm*—Calfee, Halter & Griswold, LLP

(57) ABSTRACT

A high strength cast aluminum-beryllium alloy including magnesium represented by the formula (25–60% Al)+(40–75% Be)+(0.1–1.25% Mg)+(0<X≦5%)+(0<Y≦4%)+(0<Z≦0.75%)=100, wherein: X is at least one element selected from the group consisting of nickel, cobalt and copper; Y is at least one element selected from the group consisting of silicon and silver; and Z is at least one element selected from the group consisting of iron, titanium, zirconium, boron, antimony, strontium, germanium, scandium and the rare earth elements.

33 Claims, 16 Drawing Sheets

U.S. PATENT DOCUMENTS

| | | | | |
|---|---|---|---|---|
| 1,976,375 | * | 10/1934 | Smith | 420/533 |
| 2,399,104 | | 4/1946 | Cooper | 420/528 |
| 2,486,475 | | 11/1949 | Kawecki | 420/401 |
| 3,323,880 | | 6/1967 | Krock et al. . | |
| 3,325,257 | | 6/1967 | Ang et al. . | |
| 3,337,334 | | 8/1967 | Fenn, Jr. et al. | 420/401 |
| 3,373,002 | | 3/1968 | Larsen et al. . | |
| 3,373,004 | | 3/1968 | Larsen et al. | 420/401 |
| 3,378,356 | | 4/1968 | Larsen et al. . | |
| 3,456,322 | | 7/1969 | Krock et al. . | |
| 3,456,332 | | 7/1969 | Belalov et al. . | |
| 3,506,438 | | 4/1970 | Krock et al. . | |
| 3,548,915 | * | 12/1970 | Richmond et al. | 420/528 |
| 3,548,948 | | 12/1970 | Richmond et al. | 164/68 |
| 3,558,305 | | 1/1971 | Griffiths . | |
| 3,664,889 | * | 5/1972 | McCarthy et al. | 420/529 |
| 3,715,206 | | 2/1973 | Komatsu et al. . | |
| 4,229,210 | | 10/1980 | Winter et al. . | |
| 4,434,837 | | 3/1984 | Winter et al. . | |
| 4,482,012 | | 11/1984 | Young et al. . | |
| 4,694,881 | | 9/1987 | Busk . | |
| 4,694,882 | | 9/1987 | Busk . | |
| 4,771,818 | | 9/1988 | Kenney . | |
| 5,040,589 | | 8/1991 | Bradley et al. . | |
| 5,167,733 | | 12/1992 | Hsieh . | |
| 5,169,462 | | 12/1992 | Morley et al. . | |
| 5,184,260 | | 2/1993 | Pierrat . | |
| 5,260,847 | * | 11/1993 | Basehore et al. | 360/106 |
| 5,289,865 | | 3/1994 | Sun . | |
| 5,417,778 | * | 5/1995 | Nachtrab et al. | 148/400 |
| 5,421,916 | * | 6/1995 | Nachtrab et al. | 148/400 |
| 5,518,240 | | 5/1996 | Igarashi . | |
| 5,551,997 | * | 9/1996 | Marder et al. | 148/437 |
| 5,578,146 | * | 11/1996 | Grant et al. | 148/437 |
| 5,603,780 | * | 2/1997 | Nachtrab et al. | 148/400 |
| 5,620,652 | | 4/1997 | Tack et al. . | |
| 5,642,773 | * | 7/1997 | Grensing et al. | 148/547 |
| 5,667,600 | * | 9/1997 | Grensing et al. | 148/437 |

OTHER PUBLICATIONS

Kenney et al., *Semisolid Metal Casting and Forging*, Metals Handbook, Dec. 1988, vol. 15, pp. 327–338.

Flemings, M.C., *Behavior of Metal Alloys in the Semisolid State*, Metallurgical Transactions, Dec. 1991, vol. 22A, pp. 957–981.

Marder et al., *P/M Lightweight Metals*, Metals Handbook, 9th Edition, Dec. 1984, vol. 7, pp. 755–763.

Hashiguchi, D.H. (Brush Wellman, Inc.) et al., *Ternary Aluminum–Beryllium Alloys*, Metal Powder, Industries Fed., 105 College Rd. East, Princeton, NJ 08540–6692, USA, 1995, 12.3–12.17, Photomicrographs, Numerical Data, Graphs, 7 Ref. Conference: Advances in Powder Metallurgy and Particulate Materials–Dec. 1995, vol. 3, Seattle, WA, XP–002095850.

* cited by examiner

HIGH STRENGTH CAST ALUMINUM-BERYLLIUM ALLOYS CONTAINING MAGNESIUM

This application claims benefit to provisional No. 60/030,949 filed Nov. 15, 1996; which is a continuation-in-part of co-pending application Ser. No. 08/937,274, filed on Sep. 15, 1997 now U.S. Pat. No. 6,042,658, which is a continuation of application Ser. No. 08/221,935 filed Apr. 1, 1994, which issued as U.S. Pat. No. 5,667,600 on Sep. 16, 1997.

BACKGROUND OF THE INVENTION

The present invention relates generally to alloys and, more particularly, to a novel cast aluminum-beryllium alloy having superior strength, corrosion resistance, x-ray cross-section, and environmental acceptability.

Aluminum-beryllium alloys are known for their unique combination of properties, including strength, stiffness, lightness, machinability and corrosion resistance. Their appeal for commercial applications ranging from aircraft components to actuator armsets for computer disk drives has been recognized for some time.

Efforts have been made to refine and develop properties of these alloys in order to expand their commercial viability. This is typically accomplished by varying the alloy constituent levels. For instance, increased beryllium levels are known to prevent oxidation of aluminum and other alloy components. Nickel, cobalt and copper additions have been found to as enhance alloy strength and toughness.

In an attempt to make aluminum-beryllium alloys more commercially feasible, magnesium addition have also been used. While this has improved ductility, other characteristics of magnesium have precluded its use in vacuum cast alloy applications. They include volatility, strength, and work hardening coefficient. As a result, commercial viability of conventional aluminum-beryllium alloys has been limited.

SUMMARY OF THE INVENTION

It is therefore an object of the present invention to expand the commercial viability of high performance aluminum-beryllium alloys.

Another object of the present invention to provide a high performance alloy with improved ductility.

Still another object of the present invention is to provide a high performance aluminum-beryllium alloy suitable for investment casting processes.

Another object of the present invention is the production of a high strength, cast aluminum-beryllium alloy containing magnesium.

Yet another object of the present invention is to provide an aluminum-beryllium-copper alloy containing magnesium with improved ductility without sacrificing investment castability.

A further object of the present invention is to provide an aluminum-beryllium-nickel alloy containing magnesium with improved ductility, without sacrificing investment castability.

Still a further object of the present invention is to provide simple and efficient production of investment cast aluminum-beryllium alloy products.

Yet a further object of the present invention is to provide economical, high strength, investment cast products of aluminum-beryllium-copper alloys containing magnesium.

Another object of the present invention is to provide economical, high strength, investment cast products of aluminum-beryllium-nickel alloys containing magnesium.

In accordance with one aspect of the present invention is a high strength cast aluminum-beryllium alloy containing magnesium represented by the formula (25–60% Al)+(40–75% Be)+(0.1–1.25% Mg)+(0<X<5.5%)+(0<Y<4%)+(0<Z<0.75%)=100, wherein X is at least one element selected from the group consisting of nickel, cobalt and copper; Y is at least one element selected from the group consisting of silicon and silver; and Z is at least one element selected from the group consisting of iron, titanium, zirconium, boron, antimony, strontium, germanium, scandium and the rare earth elements.

According to another aspect of the present invention is an investment cast net shape article comprised of an aluminum-beryllium alloy containing magnesium represented by the formula, (25–60% Al)+(40–75% Be)+(0.1–1.25% Mg)+(0<X<5%)+(0<Y<4%)+(0<Z<0.75%)=100, where X=nickel, cobalt and/or copper, Y=silicon and/or silver, and Z=iron, titanium, zirconium, boron, antimony, strontium, germanium, scandium and/or a rare earth element.

In accordance with a further aspect of the present invention is an avionics box consisting essentially of an aluminum-beryllium alloy containing magnesium represented by the formula (25–60% Al)+(40–75% Be)+(0.1–1.25% Mg)+(0<X<5%)+(0<Y<4%)+(0<Z<0.75%)=100, where X=nickel, cobalt and/or copper, Y=silicon and/or silver, and Z=iron, titanium, zirconium, boron, antimony, strontium, germanium, scandium and/or a rare earth element.

According to still another aspect of the invention is a rotatable armset of an actuator consisting essentially of an aluminum-beryllium alloy containing magnesium represented by the formula (25–60% Al)+(40–75% Be)+(0.1–1.25% Mg)+(0<X<5%)+(0<Y<4%)+(0<Z<0.75%)=100, where X=nickel, cobalt and/or copper, Y=silicon and/or silver, and Z=iron, titanium, zirconium, boron, antimony, strontium, germanium, scandium and/or a rare earth element.

In accordance with yet a further aspect of the invention is a rotatable armset of an actuator, the armset comprising a bore for rotating about a shaft of a disk drive for positioning a head radially across a disk of the disk drive, wherein the armset is a one piece unit consisting essentially of an aluminum-beryllium-copper alloy containing magnesium.

According to yet another aspect of the present invention is a rotatable armset of an actuator, the armset comprising a bore for rotating about a shaft of a disk drive for positioning a head radially across a disk of the disk drive, wherein the armset is a one piece unit consisting essentially of an aluminum-beryllium-cobalt alloy containing magnesium.

According to a further aspect of the invention is an aluminum-beryllium-nickel alloy containing magnesium, the alloy having a first phase consisting of a primary solid solution based on the Be—β-phase with a microhardness $H_\mu$ of about 285 KSI, a second phase consisting of a solid solution based on the Al—α-phase with a microhardness $H_\mu$ of about 85 KSI, and a phase of unknown nature having a microhardness $H_\mu$ of about 714 KSI.

In accordance with still a further aspect of the present invention is a beryllium-aluminum-copper alloy system, the system structure being characterized by the presence of a Be phase (β-phase) and a slightly alloyed solid solution of beryllium in aluminum.

In accordance with yet another aspect of the present invention is a beryllium-aluminum-nickel alloy system, the system structure being characterized by the presence of a Be phase (β-phase) and a slightly alloyed solid solution of beryllium in aluminum.

According to another aspect is an end effector for a robot arm consisting essentially of an aluminum-beryllium alloy containing magnesium represented by the formula (25–60% Al)+(40–75% Be)+(0.1–1.25% Mg)+(0<X<5%)+(0<Y<4%)+(0<Z<0.75%)=100, where X=nickel, cobalt and/or copper, Y=silicon and/or silver, and Z=iron, titanium, zirconium, boron, antimony, strontium, germanium, scandium and/or a rare earth element.

In accordance with a further aspect of the invention is a piston for an automobile engine, the piston consisting essentially of an aluminum-beryllium alloy containing magnesium represented by the formula (25–60% Al)+(40–75% Be)+(0.1–1.25% Mg)+(0<X<5%)+(0<Y<4%)+(0<Z<0.75%)=100, where X=nickel, cobalt and/or copper, Y=silicon and/or silver, and Z=iron, titanium, zirconium, boron, antimony, strontium, germanium, scandium and/or a rare earth element.

According to another aspect of the present invention is a method of producing a high strength cast aluminum-beryllium alloy containing magnesium. The method comprises the steps of initially melting charges of aluminum-beryllium under vacuum, then pressuring the melt with an inert gas. Magnesium is added at a selected pressure to retard boiling. The resulting material is then cast also under a selected pressure, and cooled in an inert gas atmosphere. Alternatively or concurrently therewith, the material is cooled, again under a selected pressure.

Although the present invention is shown and described in connection with aluminum-beryllium alloys containing magnesium, it may be adapted for improving casting characteristics of other materials such as precious metals, aluminum, titanium, nickel, iron, cobalt or copper-based alloys.

BRIEF DESCRIPTION OF THE DRAWINGS

The same numerals are used throughout the figure drawings to designate similar elements. Still other objects and advantages of the present invention will become apparent from the following description of the preferred embodiments.

DETAILED DESCRIPTION OF THE PREFERRED EMBODIMENTS

Figure 1:
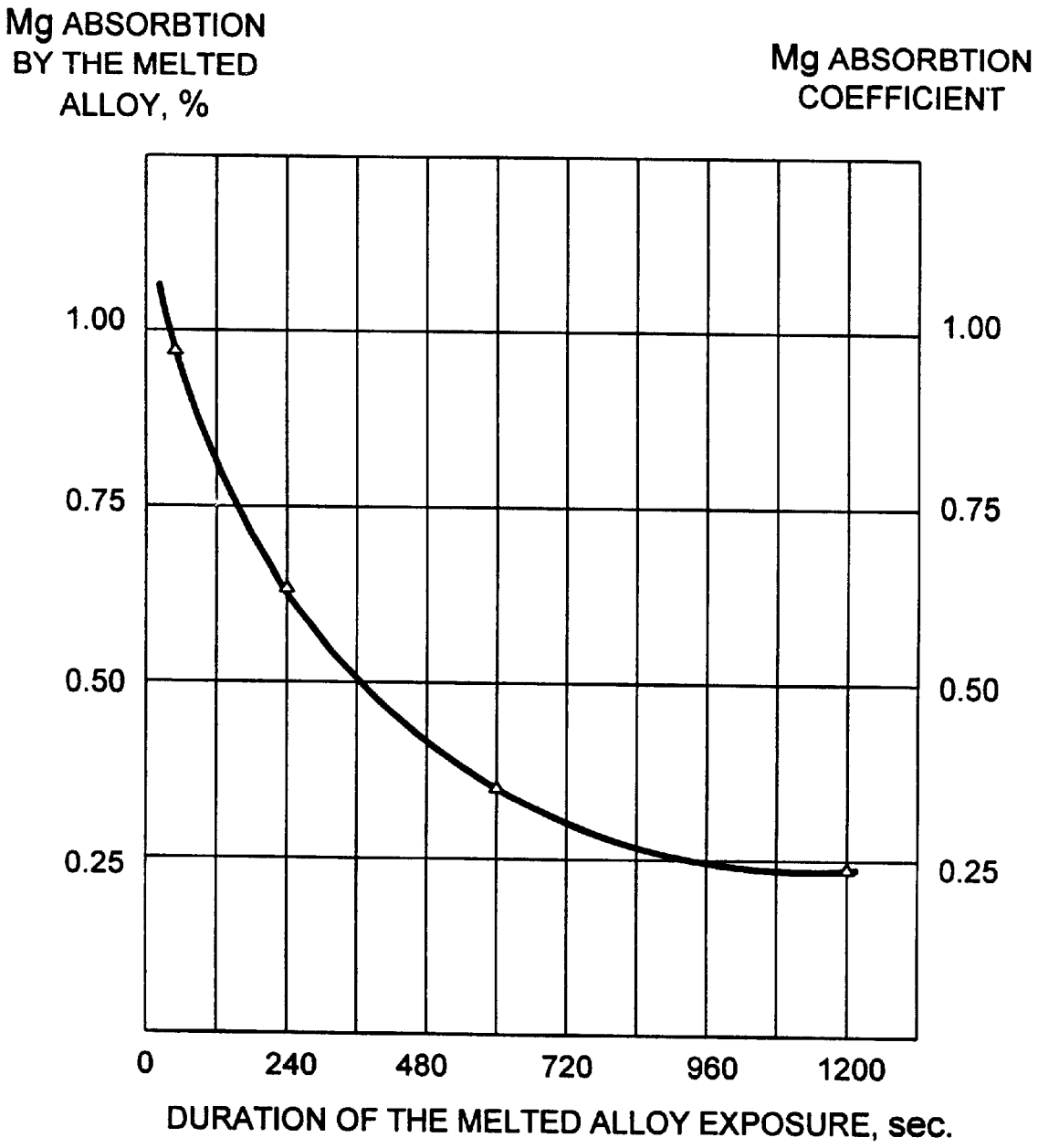
FIG. 1 is a graph showing the relationship between magnesium content and its absorption coefficient vs. duration of melted alloy exposure, in accordance with one aspect of the present invention.

The present invention relates to the discovery that a selected concentration of magnesium generally within a range of 0.1 and 1.25%, in combination with selected methods of combining magnesium with aluminum-beryllium alloys, has considerable positive influence on the alloys' physical and mechanical properties.

In accordance with one aspect of the present invention is a high strength cast aluminum-beryllium alloy containing magnesium represented by the formula (25–60% Al)+(40–75% Be)+(0.1–1.25% Mg)+(0<X<5.5%)+(0<Y<4%)+(0<Z<0.75%)=100, where X=nickel, cobalt and/or copper, Y=silicon and/or silver, and Z=iron, titanium, zirconium, boron, antimony, strontium, germanium, scandium and/or a rare earth element. The percent of each alloy constituent is preferably weight based, as will be appreciated by those skilled in the art.

According to another aspect of the present invention is a method of producing a high strength cast aluminum-beryllium alloy containing magnesium. The method comprises the steps of initially melting charges of aluminum-beryllium under vacuum, then pressuring the melt with an inert gas. Magnesium is added under a selected pressure to retard boiling. The resulting material is then cast also under a selected pressure, and cooled in an inert gas atmosphere. Alternatively or concurrently therewith, the material is cooled under a selected pressure.

EXAMPLE I

A variety of tests have been conducted on alloys of the present invention. For example, according to one aspect of the present invention, a 50% Mg—Al master alloy was placed in Al foil, and hung above a crucible containing an Al—Be alloy in an vacuum. The Al—Be alloy was then melted. During melting, the vacuum was substituted by Ar gas under a pressure equal to about 650 mm Hg. The master alloy was then heated above the melted metal surface for a selected time, and immersed in the melted metal. Intensive boiling of the melted metal resulted, accompanied by considerable emission of Mg vapor.

EXAMPLE II

A Mg master alloy was placed in a container of Ni. The container was heated initially to about 873° K. A 50% Mg—Al master alloy was then introduced into the container and melted. This resulted in intense evaporation of Mg and splashing of melted metal when added to molten Al—Be. Introduction of a less concentrated Mg master alloy did not appear to affect reaction intensity. Absorption of Mg was more unsteady than in Example I. Similar results occurred upon use of a Ni—Mg master alloy.

EXAMPLE III

A crucible of molten Al—Be alloy was prepared in a vacuum and the cooled to between about 1000° C. and about 1100° C. to form a solidified skin on the surface. Argon was then introduced to raise the vacuum to 1 atmosphere in the furnace. A 50/50 Mg—Al master alloy wrapped in aluminum foil was then placed on the solidified surface of the melted alloy. Gradually, the master alloy melted. Further heating was done simultaneously with heating of the melted metal and, the melted liquid master alloy being mixed with the melted liquid metal at about the same temperature. By this method, metal splashing was eliminated and Mg evaporation was less intensive. Further, an adoption coefficient was provided equal to about 0.7 while reliable alloy fabrication was maintained at a desirable Mg concentration. This is demonstrated in TABLE I below.

TABLE I

Mg Absorption by a Be-32Al-4Ni Alloy Depending on Introduction and Method

| Method of Mg introduction into the melted alloy | Mg content, weight % | | |
|---|---|---|---|
| | In burden material | Actually in alloy | Absorption coefficient |
| Pouring of the melted | 0.25 | 0.10–0.20 | 0.4–0.6 |
| Al-50 Mg master alloy | 0.50 | 0.20–0.35 | 0.4–0.7 |
| into the melted alloy | 1.00 | 0.10–0.21 | 0.1–0.2 |
| Al-50 Mg master alloy | 0.5 | 0.13–0.27 | 0.3–0.4 |
| placed in the Ni | 1.5 | 0.18–0.28 | 0.1–0.2 |
| container | 2.5 | 0.61–1.10 | 0.2–0.4 |
| Al-50 Mg master alloy | 0.3 | 0.22–0.26 | 0.7–0.9 |
| placed on the solid | 0.7 | 0.47–0.58 | 0.7–0.8 |
| surface during | 1.2 | 1.00–1.10 | 0.8–0.9 |
| refining | 2.0 | 1.30–1.58 | 0.6–0.8 |

A significant factor in achieving alloy performance, is the melt hold time prior to pouring into the mold. Tests were conducted to correlate melt hold time with retained magnesium concentration. The results are shown in FIG. 1. In these tests, magnesium was introduced into the alloy to an amount of about 1%. Samples were then taken using test probes at intervals of 2, 4, 6, 10 and 20 minutes.

Analysis of the test results showed that magnesium concentration changes exponentially with time ($\tau$):

$$[\%Mg]=0.76\times\exp(-0.06(\tau))$$

Figure 2:
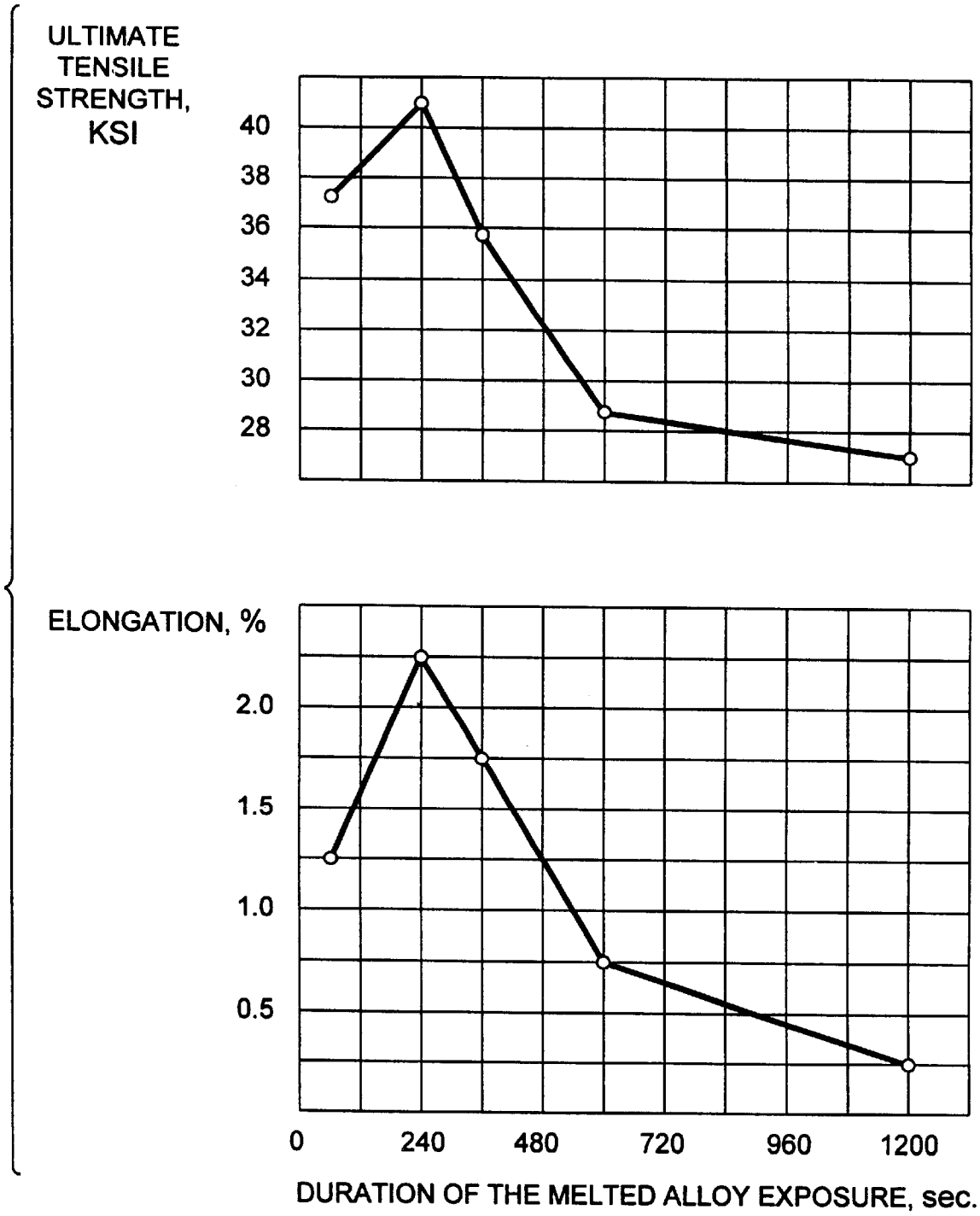
FIG. 2 is a graph showing the influence of the melted alloy exposure duration on the mechanical properties of the alloy, in accordance with the present invention.

Further, an exposure duration of about 10 minutes was found to yield about a 3 fold decrease in primary concentration, a maximum occurring after about 4 minutes of exposure, as shown in FIG. 2. This phenomena is believed to be the result of a more homogeneous distribution of magnesium in the alloy.

This data demonstrates that Be—Al—Ni—Mg alloys can now be readily produced at magnesium concentrations required for a variety of commercial applications.

EXAMPLE IV

A charge consisting of 1100 grade Al, vacuum cast Be lump, and Ni shot was measured out in the following proportions: 31% Al, 65% Be and 4% Ni. These materials were placed in BeO or $Al_2O_3$ crucible and induction heated in a vacuum below about 250 microns. When the alloy reached a temperature of about 1250° C., the vacuum furnace was backfilled with Ar gas until the vacuum was just below 1 atmosphere. A Mg ribbon of sufficient quality to produce about a 1.5% Mg level in the alloy was then run into the melt. The melt was stirred by induction for several minutes to promote mixing. After mixing, the melt was poured into a graphite mold and cooled in He, Ar, or N gas.

EXAMPLE V

An alloy melt was made according to the procedure of Example IV, but then poured into a net-shape investment casting mold made using lost wax or a similar method. A process of this general description is shown, for example, in U.S. Pat. No. 5,642,773, which issued on Jul. 1, 1997, entitled "Aluminum Alloys Containing Beryllium And Investment Casting Of Such Alloys", the disclosure of which is hereby incorporated by reference it its entirety. Thereafter, the mold was cooled in an inert gas such as N or Ar.

EXAMPLE VI

An alloy melt was processed, as described in Examples IV and V, except that after pouring the mold was placed in a pressure vessel and pressurized. A pressure of 180 psi was found optimum for minimizing boiling and casting porosity. Pressures higher and lower than 180 psi may be used successfully.

The general concept of using high pressure to retard Mg boiling may be used during any combination of melting, casting, and cooling. This technology can also be applied to maintain Zn or Li additions in the melt. A different optimum pressure could be used for each alloying element.

Figure 3:
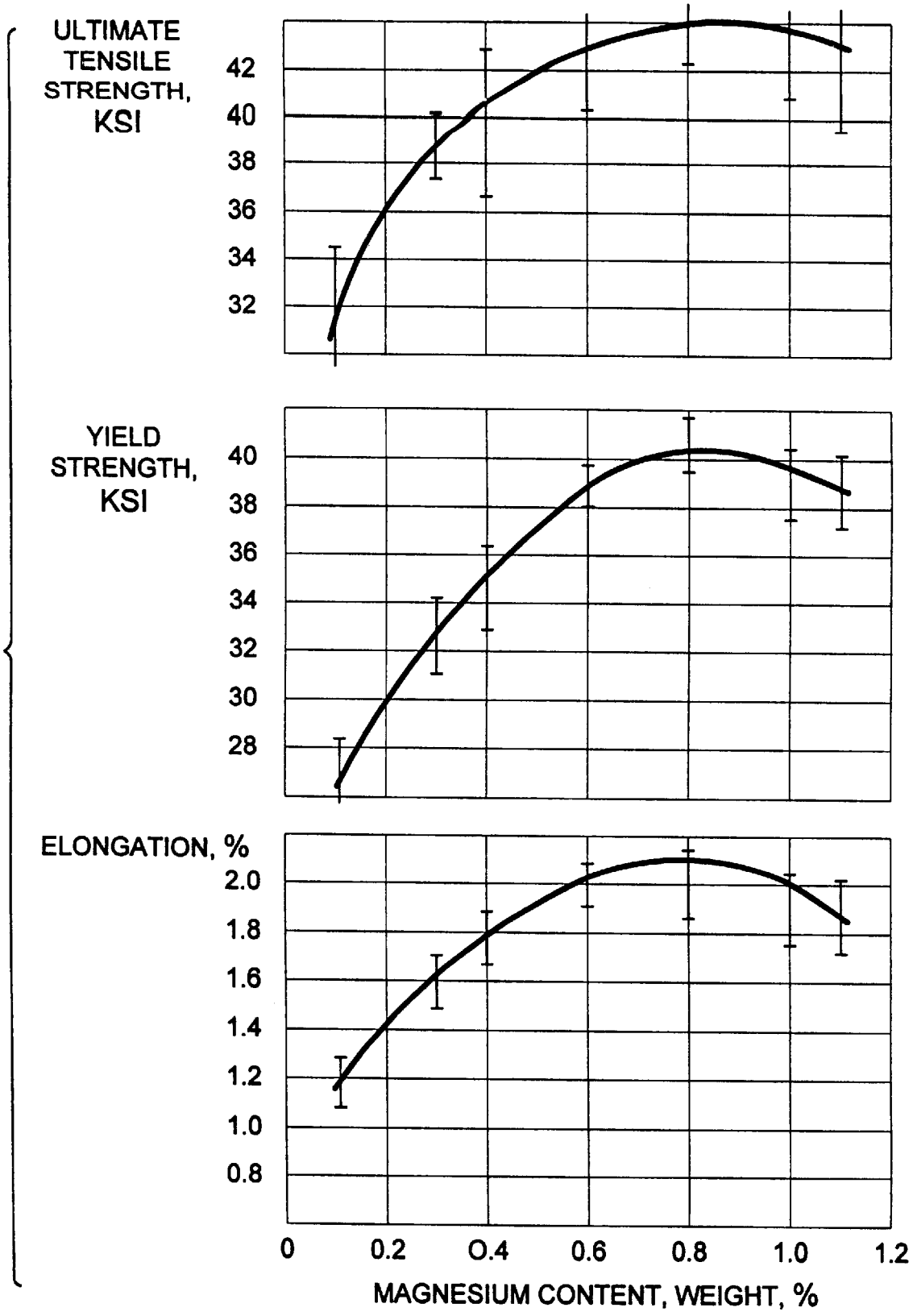
FIG. 3 is a graph showing the relationship between mechanical properties of a Be-(36–40)Al-(4.5–5.5)Ni alloy and its magnesium content, in accordance with the present invention.

A series of experimental meltings of Be—Al—Ni alloys containing Mg were conducted, according to various aspects of the present invention, where the Mg concentration was increased from about 0.15% to about 1.5%. The samples comprised Ni generally within a range of 4.5% and 5.5% and Al generally within a range of 36% and 40%, the balance substantially Be. The results of mechanical testing are set forth in TABLE II below and in FIG. 3.

TABLE II

Mechanical Properties of the Be-(36–40)Al-(4.5–5.5)Ni Alloy vs. Magnesium Content.

| NN. Mg content, weight % | Mechanical properties: Ultimate Tensile Strength KSI | Yield strength (tensile) KSI | Elongation % |
|---|---|---|---|
| 1 0.1 | 29.4, 32.9, 34.5 | 28.4, 28.4, 27.3 | 1.2, 1.1, 1.3 |
| | 27.8, 34.4 | 27.7, 26.0 | 1.1, 1.2 |
| | 31.8 | 27.6 | 1.2 |
| 2 0.3 | 39.9, 37.7, 40.2 | 34.2, 33.6, 31.1 | 1.4, 1.6, 1.6 |
| | 37.4, 39.5 | 33.9, 33.9 | 1.6, 1.7 |
| | 39.9 | 33.4 | 1.6 |
| 3 0.4 | 42.6, 43.3, 36.5 | 33.2, 34.8, 34.2 | 1.6, 1.8, 1.9 |
| | 41.8, 38.9 | 35.2, 36.5 | 1.8, 1.8 |
| | 40.6 | 34.8 | 1.8 |
| 4 0.6 | 40.2, 44.8, 41.2 | 38.8, 39.9, 39.8 | 2.1, 2.0, 1.9 |
| | 45.7, 45.4 | 38.6. 36.5 | 2.0, 1.9 |
| | 43.4 | 39.0 | 2.0 |
| 5 0.8 | 45.7, 42.3, 44.7 | 39.8, 41.3, 40.9 | 2.0, 2.2, 2.1 |
| | 45.7, 45.4 | 38.6. 38.2 | 2.0, 1.9 |
| | 44.2 | 40.6 | 2.1 |
| 6 1.0 | 43.3, 40.7, 41.6 | 40.2, 37.6, 40.9 | 2.0, 2.1, 2.1 |
| | 44.3, 45.2 | 40.5, 40.6 | 2.0., 2.1 |
| | 43.0 | 39.2 | 2.0 |
| 7 1.1 | 43.5, 40.5, 42.6 | 40.0, 37.8, 40.3 | 2.0, 1.9, 1.8 |
| | 39.8, 43.9 | 37.5, 39.8 | 1.8, 1.9 |
| | 42.0 | 39.0 | 1.9 |

This demonstrates a gradual increase in alloy strength with increased Mg concentration, the concentration rising to between about 0.6% and about 1.0%, above which strength decreases. Elongation varied in about the same manner. A primary Mg concentration between about 0.7% and about 0.9% provided an ultimate tensile strength greater than or equal to about 43 KSI and an elongation of about 2%.

Increasing Mg content decreased melt fluidity. For instance, without a superheat of 150° C., the introduction of Mg generally within a range of 0.2% and 0.4% did not permit the alloy melt to fill walls about 5 mm thick or less. This generally worsened with increasing pressure.

Figure 4:
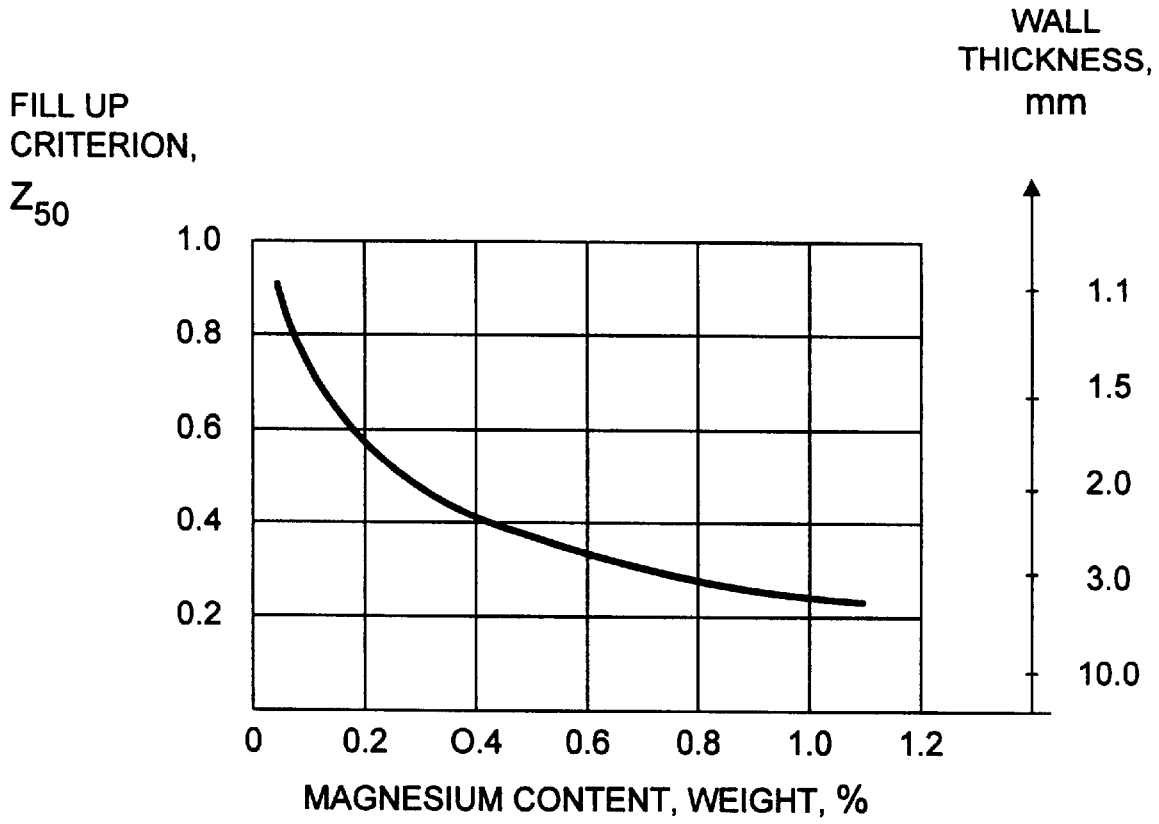
FIG. 4 is a graph illustrating the mold fill dependence on magnesium content, according to the present invention.

To increase fillability, ventilation holes were placed in upper portions of the molds to insure passage of Mg vapor and other gases from the mold. FIG. 4 illustrates a dependence of probe half height filling criterion Z50 (which corresponds to a wall height equal to about 50 mm) on Mg content.

Alloys containing about 0.6% to about 0.8% Mg were found unable to fill the 50 mm height wall with a thickness less than about 2.5 mm. Increased Mg concentration, it was found, further decreased fill. Be—Al—Ni alloys containing Mg exhibited high strength characteristics with moderate castability.

Influence of Al and Ni content on mechanical properties and Fluidity, where Mg concentration remained generally within a range of 0.6% and 0.8%, was investigated using mathematical regression methods ($2^2$ matrix). Equations of the regression are as follows:

$$(\sigma^B)=250+19[\mathrm{Al}]+14[\mathrm{Ni}]$$

$$(\delta)=1.69+0.85[\mathrm{Al}]-0.5[\mathrm{Ni}]$$

$$(Z_{50})=0.515+002[\mathrm{Al}]$$

The values of [Al] and [Ni] were determined by the following equations:

$$[\mathrm{Al}] = \frac{X_{Al} - 36}{4}$$

$$[\mathrm{Ni}] = \frac{X_{Ni} - 3.5}{1.5},$$

where $X_{Al}$ and $X_{Ni}$ correspond to Al and Ni contents, respectively, in alloy.

It was learned from these equations that strength of the alloy systems increases with increase in both Al and Ni content. Increased elongation occurred with the addition of Al, and decreased elongation was achieved by adding more Ni. Alloy Fluidity was determined by the Mg content of the melted metal. Fluidity generally increased with increasing Al content, but did not appear to depend on Ni content.

ANALYSIS

Detailed analysis of Be—Al—Ni alloys containing Mg was conducted. The alloy evaluated comprised about 38% Al, about: 4% Ni, and about 0.7% Mg, the balance substantially Be. Impurity concentrations in the alloys were as follows: Fe<about 0.15%, $O_2$<about 0.1%, and Si<about 0.1%.

1. Phase Composition

The alloy consisted of two main phases: (i) a primary solid solution based on the hep Be phase having a microhardness $H_\mu$ of about 285 KSI, and (ii) a solid solution based on the Fcc Al phase with a microhardness $H_\mu$ of about 85 KSI. Also present in the alloy was a phase of unknown nature having a microhardness $H_\mu$ of about 714 KSI.

2. Physical Properties

Physical properties of the alloy are shown in TABLE III. The coefficient of thermal expansion (α) was computed using a heating rate equal to about 2° C./min. The thermal conductivity coefficient was determined using calculated values of mean specific heat and temperature conductivity coefficient.

TABLE III

Physical Properties of the Be-38Al-4Ni-0.7 Mg Alloy

| Property | Testing Temperature, ° C. | Value |
|---|---|---|
| Density, gm/cm$^3$. | 20 | 2.17 |
| Coefficient of Thermal | 20–100 | 15.9 |
| Expansion, α $10^{-6}$, 1/° C. | 20–200 | 16.5 |
| | 20–300 | 16.8 |
| Specific Heat, $C_p$, kJ/ kg K. | 20 | 1.45 |
| Thermal Diffusivity, a, $10^4$ m$^2$/sec | 20 | 0.27 |
| Thermal Conductivity, w/m K | 20 | 85 |
| Specific Resistance, ρ $10^8$ Ohm m | 20 | 8.0–8.5 |
| Freezing Range, ° C. | | 640–1170 |

3. Mechanical Properties

Presented below in TABLE IV are mechanical properties of the alloy as a function of temperature. The following properties are the result of 10 trials.

| | |
|---|---|
| Tensile Strength, $\sigma_B$ | 35–45 KSI |
| Yield Strength, $\sigma_{0.2}$ | 34–38 KSI |

-continued

| | |
|---|---|
| Elongation, δ | 2–3% |
| Percentage Reduction of Area | 2–3.5% |

TABLE IV

Mechanical Properties of the Be-38Al-4Ni-0.7 Mg Alloy

| Property | Temperature, ° C. −100 | 20 | 100 | 200 | 300 | 400 |
|---|---|---|---|---|---|---|
| Elastic Modulus, E, KSI. | | 28 | 570 | | | |
| Ultimate Tensile Strength, KSI. | 40 | 35 | 34 | 25 | 17 | 10 |
| Yield Strength, KSI | 33 | 31 | 27 | 23 | 15 | 8 |
| Elongation, % | 2 | 2.1 | 2.1 | 2.2 | 3 | 4 |
| Percentage Reduction of Area, % | 2 | 2.1 | 3 | 3 | 4 | 6 |

4. Dimensional Stability

Dimensional stability characteristics of the alloy are provided below in TABLE V.

TABLE V

Dimensional Stability Characteristics of the Be-38Al-4Ni-0.7 Mg Alloy

| Characteristic | Specimen | Temperature | Value |
|---|---|---|---|
| Precision Elastic Limited, 0.005% offset, KSI. | Gage Diameter is 5 mm. | 20 | 8.0 |
| Stress Relaxation Limit, 0.005% offset, 500 h. | Ring specimen of equal strength | 100 | 6.0 |
| Thermal Conductivity/ Coefficient of Thermal Expansion Ratio, $10^6$, w/m | | 20–100 | 5.35 |

5. Other Properties

Weldability was satisfactory and casting was done with minimal defects. The alloy was machinable using a carbide tool, but diamond is preferred. A tendency to form hot cracks was noted with cross sections greater than 5×5 mm. Linear shrinkage was generally within a range of 1.1% and 1.2%, while total (or volume) shrinkage was about 9.2%. Shrinkage porosity was up to about 4.3%.

Fluidity was determined according to previously described methods. Poured metal temperatures were generally within a range of 1250° C. and 1300° C., and mold temperatures were about 600° C. The relationship between the height and thickness of the filled wall is provided below:

| Wall Thickness, mm | Height Of The Filled In Wall, mm |
|---|---|
| 1.5 | 25–40 |
| 2.0 | 60–80 |
| 2.5 | 80–100 |
| 3.0 | 100 |

The alloys in to the present invention were corrosion resistant. During a 90-day test of alloy specimens at a relative humidity of about 98% and at a temperature of about 50° C., no corrosion was revealed.

Turning now to another aspect of the present invention, there is provided a Be—Al—Cu alloy system. The system structure is characterized by the presence of a hep Be phase and a degenerated eutectic that consists of a slightly alloyed solid solution of beryllium in aluminum. To improve mechanical characteristics of these alloys, additional alloying is provided using appropriate alloying elements. The elements are selected according to Be-metal phase diagrams.

From analysis of these diagrams, Cu was found promising as a main alloying element. Cu is known for its effectiveness as an aluminum and beryllium strengthening element. This is believed due to the solubility of Cu both in Be and Al, as illustrated by the Be—Cu and Al—Cu diagrams. Specimens tested were Be—Al—Cu alloys comprising about 60% to about 70% Be, about 20% to about 40% Al, and about 2% to about 10% Cu.

The nature and composition of the separate phases, and their dependance on copper content was determined using various analytical methods. Physical and chemical methods were utilized, based on selective and differential solubility of separate phases in different solutions. Dissolution of the Al-phase in 2% NaOH solution was accompanied by the precipitation of Cu. Solubility of the Be5AlMe phase in the same solution was accompanied by the transition of Cu into solution, the solubility of Cu in concentrated $HNO_3$ solution, and the solubility of the Be-phase in the 2% solution.

Figure 5:
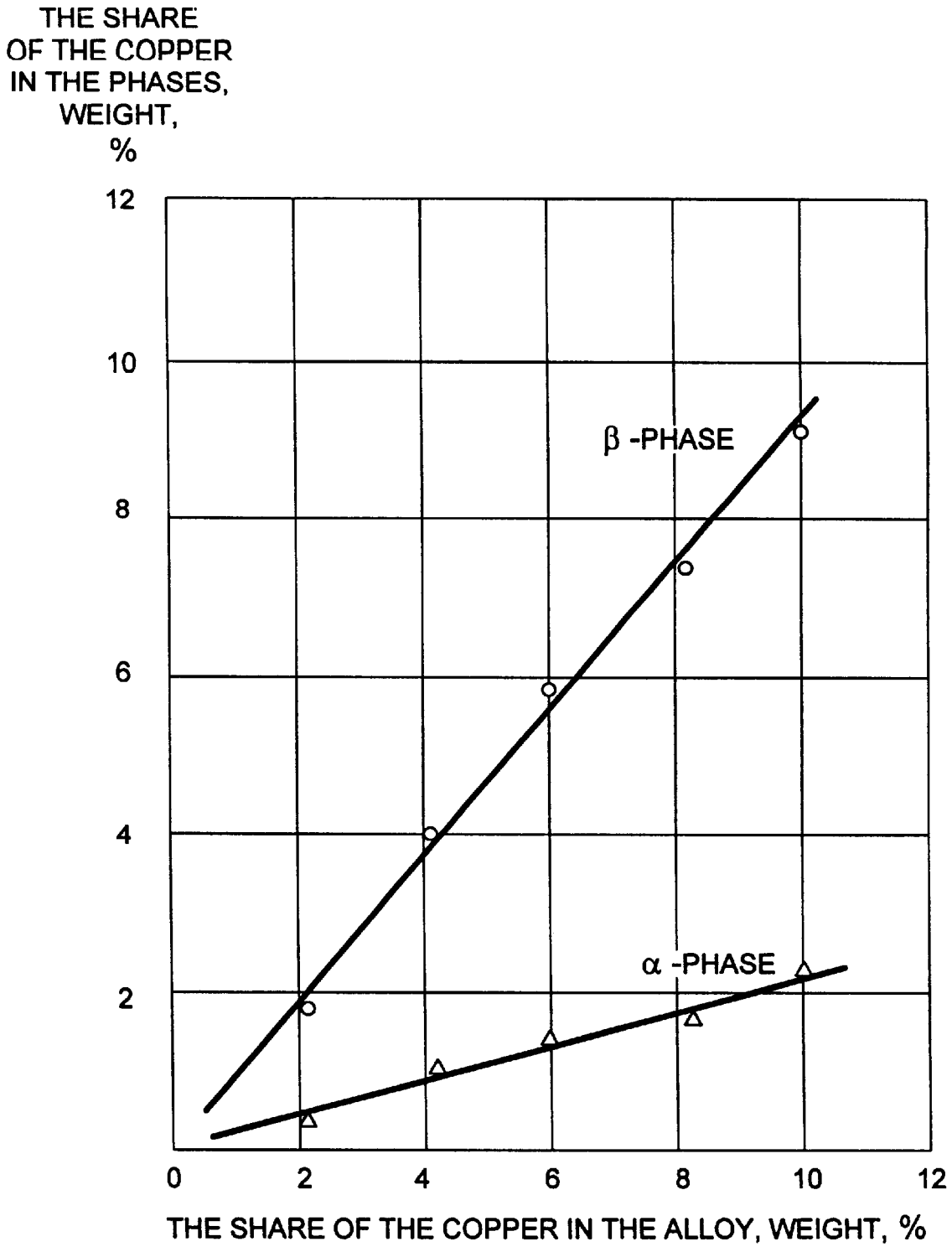
FIG. 5 is a graph of the α- and β-phase copper concentration vs. concentration of copper in the alloy, according to the present invention.

X-ray methods were used to determine chemical composition of the phases (URS-60 device, characteristic $Ni_k\alpha$ radiation) in combination with chemical analysis of the initial alloy composition. This allowed determination of the phases' elemental composition. Evaluation of the phase composition and of the Cu content in different phases of Be—Al—Cu alloys was also investigated. The results are shown below in TABLE VI and FIG. 5. For purposes of comparison, TABLE VI shows data on local X-ray analysis performed by microanalyses. The correlation between the results confirms the reliability of this technique. It also shows that copper content in the β-phase coincides with its content in the alloy. The concentration of Cu in the α-phase increases from about 0.1% to about 0.3% in the 2% Cu alloy, and up to about 2% to about 4% in the 8.0% to 9.4% Cu alloy.

As shown in TABLE VII, the absolute copper content in various phases of aluminum-beryllium-copper alloys, and the amount of copper in the β-phase is about 80% of the total copper present in the alloy. The share of copper in the α-phase

TABLE VI

Chemical Composition of Be-Al-CU Alloys in Accordance with the Results of the Physical and Chemical Analysis (1) as well as Local X-ray Spectra Analysis (2)

| Element Composition | Phase Composition weight % β-phase | | α-phase | | Be-5 intermetalics |
|---|---|---|---|---|---|
| weight % | 1 | 2 | 1 | 2 | 2 |
| Be base | 97.85 | base | absent | balance | — |
| Al 32 | 0.15 | — | 99.9 | 99.7 | — |
| Cu 2 | 2.0 | 2.0 | 0.13 | 0.35 | — |
| Be base | 94.70 | base | 0.01 | balance | — |
| Al 32 | 0.2 | — | 0.01 | 99.0 | — |
| Cu 2 | | | | | |
| Be base | — | base | — | balance | balance |
| Al 30.0 | — | — | — | 99.0 | 12 |

TABLE VI-continued

Chemical Composition of Be-Al-CU Alloys in Accordance with the Results of the Physical and Chemical Analysis (1) as well as Local X-ray Spectra Analysis (2)

| Element Composition | | Phase Composition weight % | | | | |
|---|---|---|---|---|---|---|
| | | β-phase | | α-phase | | Be-5 intermetalics |
| weight % | | 1 | 2 | 1 | 2 | 2 |
| Cu | 6.0 | — | 6.0 | — | 1.40 | 4.0 |
| Fe | — | — | — | — | 10.0 | — |
| Be | base | 88.80 | base | 0.01 | balance | — |
| Al | 30.0 | 0.20 | — | 97.8 | 98.0 | — |
| Cu | 8.0 | 12.0 | 8.0 | 2.1 | 2.0 | — |
| Be | base | — | base | 0.01 | balance | — |
| Al | 30.0 | — | — | 96.0 | 97.0 | — |
| Cu | 9.4 | — | 9.6 | 4.0 | 2.0 | — |

TABLE VII

Copper Distribution by Phases of Be-Al-Cu Alloys.

Figure 6:
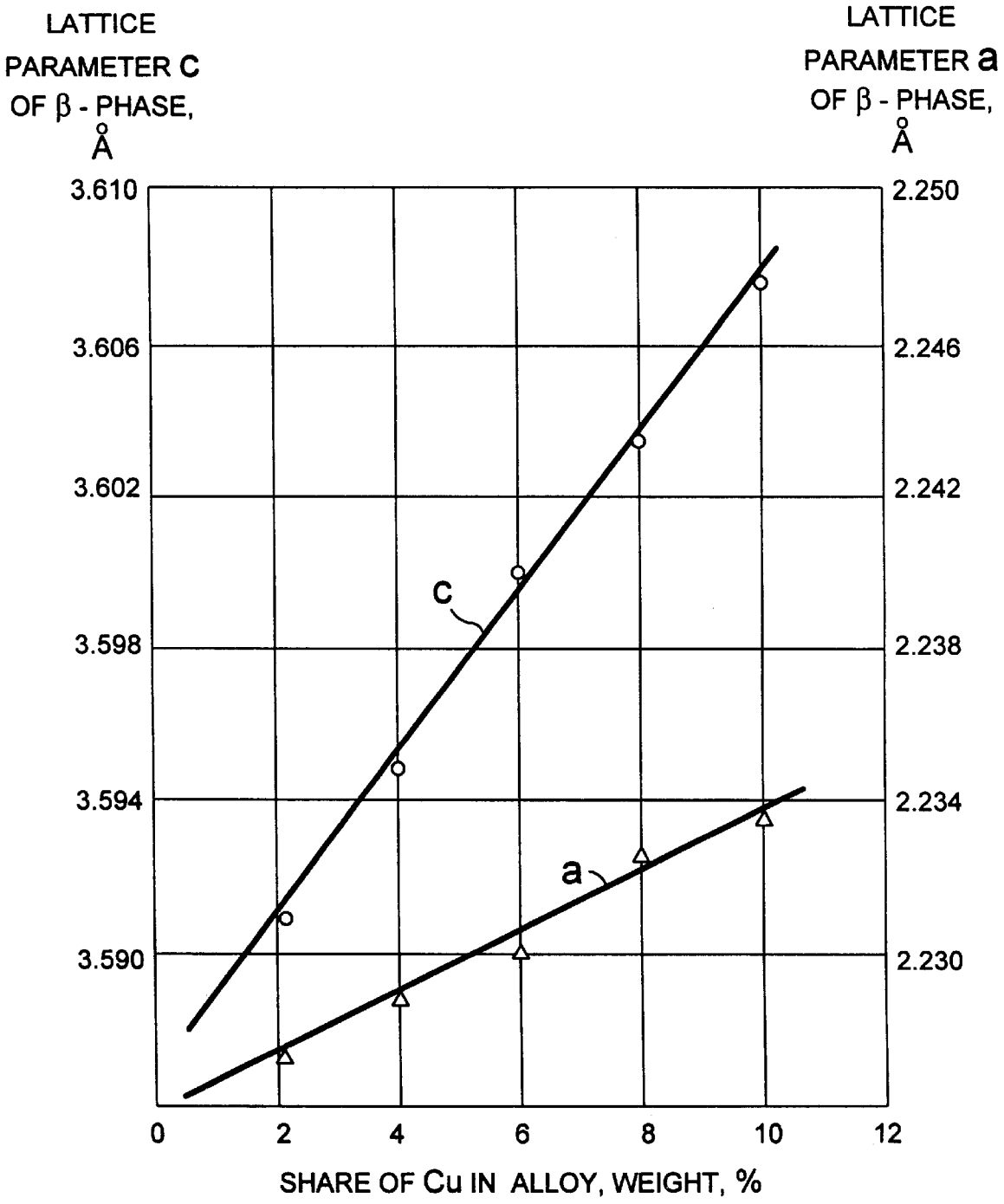
FIG. 6 is a graph illustrating lattice parameters of the β-phase vs. copper content in the alloy, in accordance with the present invention.
Figure 7:
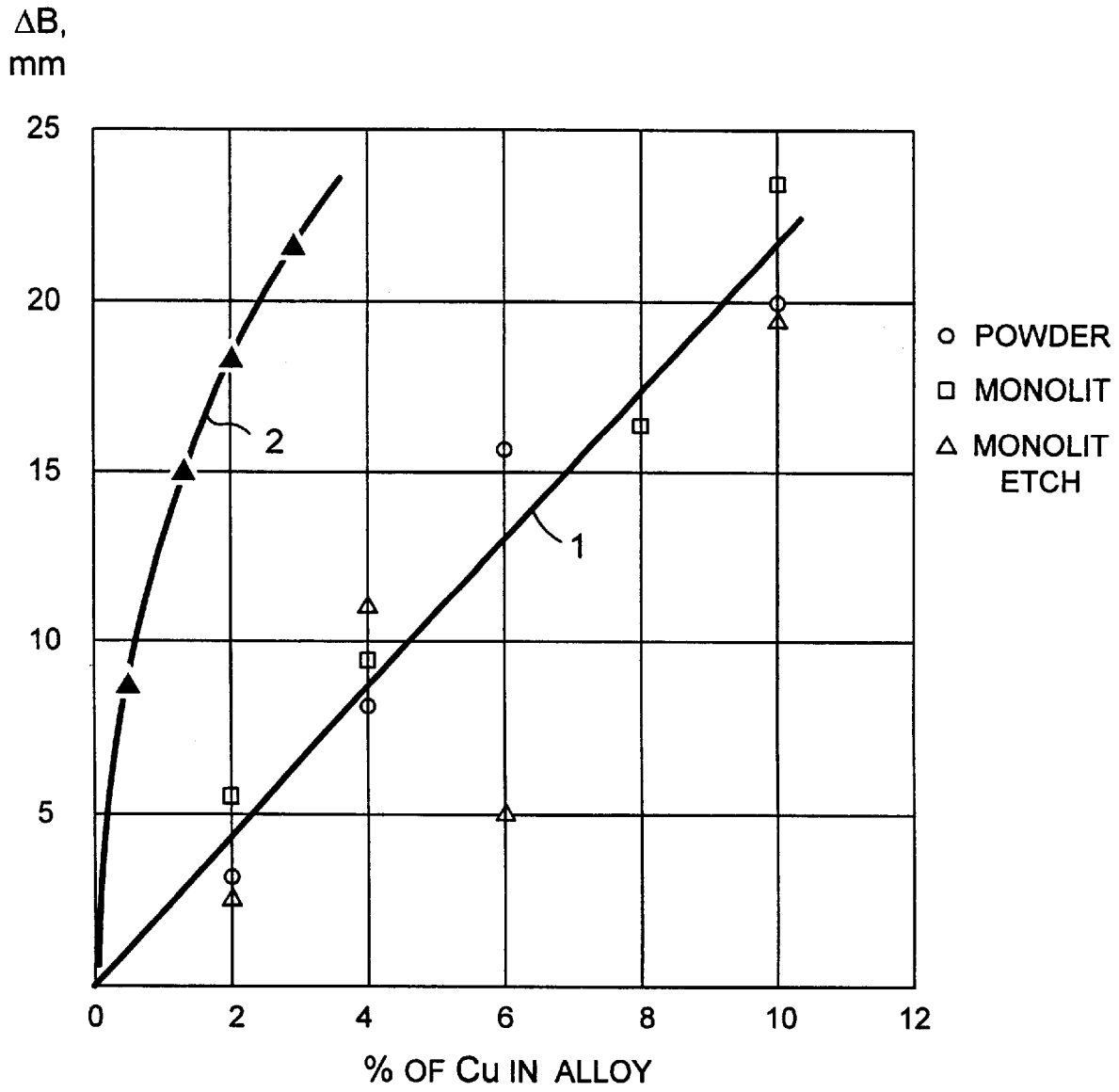
FIG. 7 is a graph showing the width of aluminum lines in the alloy (1) and α-phase (2) vs. copper content, according to the present invention.

| Alloy composition weight %. | | Copper content in phases (weight of copper in phase/weight of copper in alloy). | | | | |
|---|---|---|---|---|---|---|
| Be | Al | Cu | β | α | intermetalics | BeCu |
| 66 | 32 | 2 | 77 | 2 | 6 | 15 |
| 64 | 32 | 4 | 82 | 5 | 3 | 10 |
| 61 | 31 | 8 | 82 | 7 | 1 | 10 |
| 60 | 30.6 | 9.4 | 79 | 14 | 1 | 6 |

increases from about 2% to about 14%, as Cu content in the alloy increases from about 2% to about 9.4%. The formation of Cu solid solution in Be and Al (β- and α-solutions) is confirmed by the change in crystal lattice parameters in these phases, set forth in FIG. 6, and by widening of lines in the α-phase, as shown in FIG. 7.

Comparison of double constituent alloys (Be—Cu) with triple constituent alloys (Be—Al—Cu) revealed the possibility of Al solubility in solid β-solution with simultaneous presence of both Cu and Al, so long as the change in lattice parameters of the triple system is larger than that of the double system.

In addition, the alloy phase composition was found not temperature sensitive and there was no noticeable change in phase composition at temperatures up to about 730–820° K. In this temperature range the BeCu and Be3Cu2Al phases dissolve, as confirmed by the disappearance of X-ray lines from these phases. Based on metallographic analysis, it is believed that these phases form the boundary of the β-phase and disappear generally within a temperature range of 730° and 820° K. by dissolving in the α- and β-phases. This determines the heat treatment temperature regimes.

Figure 8:
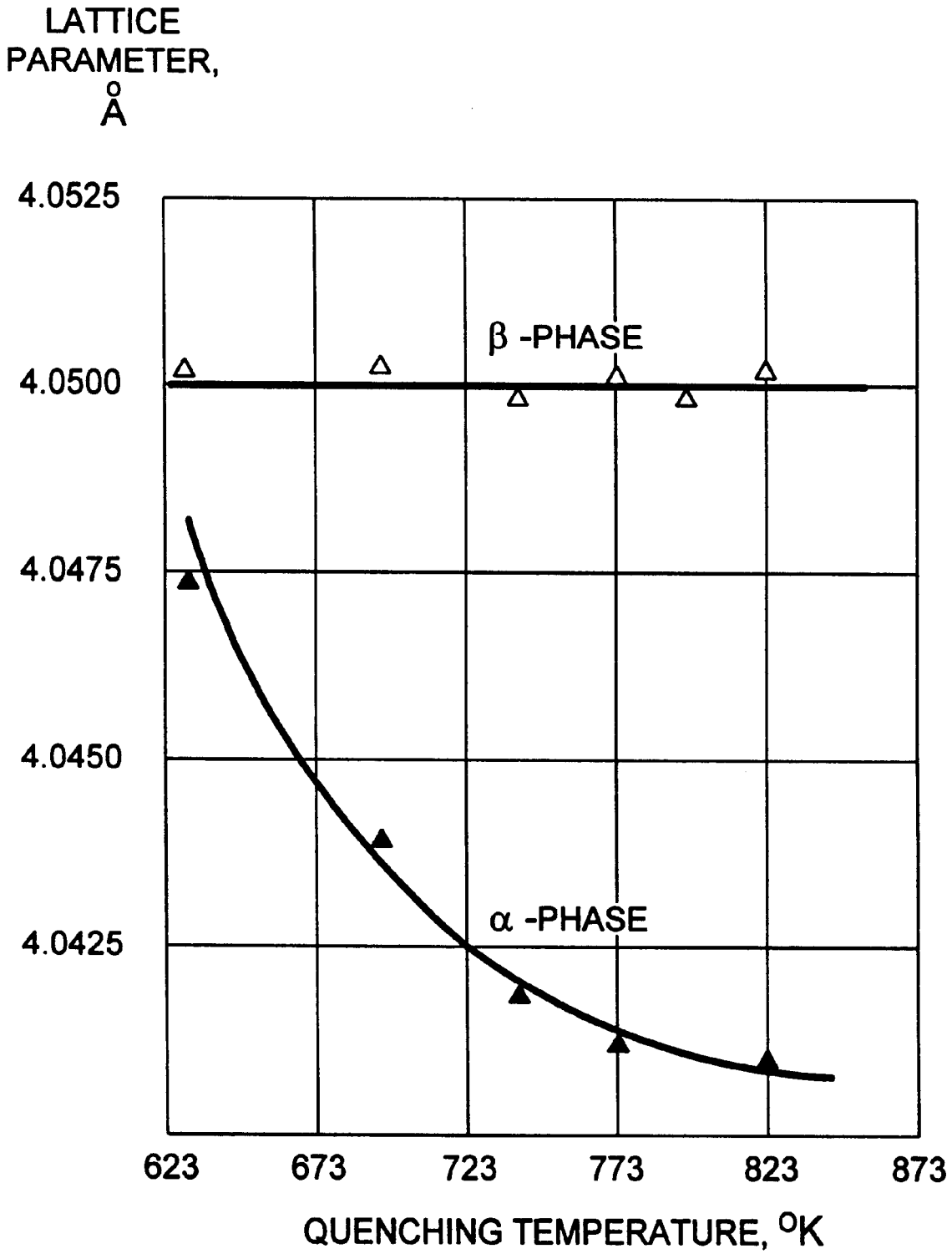
FIG. 8 is a graph of phase lattice parameters vs. quenching temperature.

Experimental data obtained from measuring the Cu lattice parameter of the alloy after casting and heat treatment confirm that alloying of Cu in the α-phase generally increases with increasing Cu content and decreasing quenching temperatures. This is demonstrated in FIG. 8. It is believed that the decreasing lattice parameter in both cases is related to a relative increase in Cu content in the α-phase.

X-ray spectroscopy methods were used to investigate micro-additions such as Mg, Mn, Cr and impurity distributions in the α- and β-phases. The distribution of Cu and Al was also determined. Mg was found uniformly distributed in the α-phase. Cu was present: in each phase, i.e., in the α-phase and β-phases, and intermetallic particles.

These analyses facilitated reliable determination of the alloys' chemical composition. They also revealed the role of Mg, and the role played by micro alloying additions and other impurities.

Table VIII shows the results of metallographic analysis of the alloys. The addition of Cu increased the interphase size by precipitating Cu on the Be grain boundaries in the form of a Be—Cu type phase. The volume fraction of Be—Cu phase generally increased with increasing Cu content, while the volume fraction of large beryllium intermetallics remained relatively constant at about 1%.

TABLE VIII

Influence of Cu on the Be—Al—Cu alloy structure

| | Composition weight, % | | | Phase volume content, % | | | | Specific border area B,α-ph | | Microhardness of phases, KSI | |
|---|---|---|---|---|---|---|---|---|---|---|---|
| | | | | | | inclusions | | | | | |
| NN | Be | Al | Cu | β-ph | α-ph | beryllides | BeCu | mm³/mm² | | β-phase | α-phase |
| 1 | 66 | 34 | — | 65 ± 2 | 34 | 0,9 | — | 50 ± 4 | 230–330 | | 64 |
| 2 | 64 | 33 | 2 | 64 ± 2 | 34 | 0,8 | 0,7 | 60 ± 4 | 300–345 | | 70 |
| 3 | 59 | 36 | 6 | 58 ± 2 | 40 | 1,2 | 1,0 | 58 ± 4 | 270–345 | | 110 |
| 4 | 64 | 28 | 9,8 | 64 ± 2 | 24 | 0,3 | 7,0 | 67 ± 4 | 290–345 | | 115 |

Additions of copper generally increased microhardness of the β-phase (the range of values being relatively large) the α-phase (aluminum matrix). This is believed due to the formation of a solid solution of copper in aluminum, and chemical variation. The noticeable increase in mechanical properties is considered a result of strengthening of the aluminum α-phase.

Figure 9:
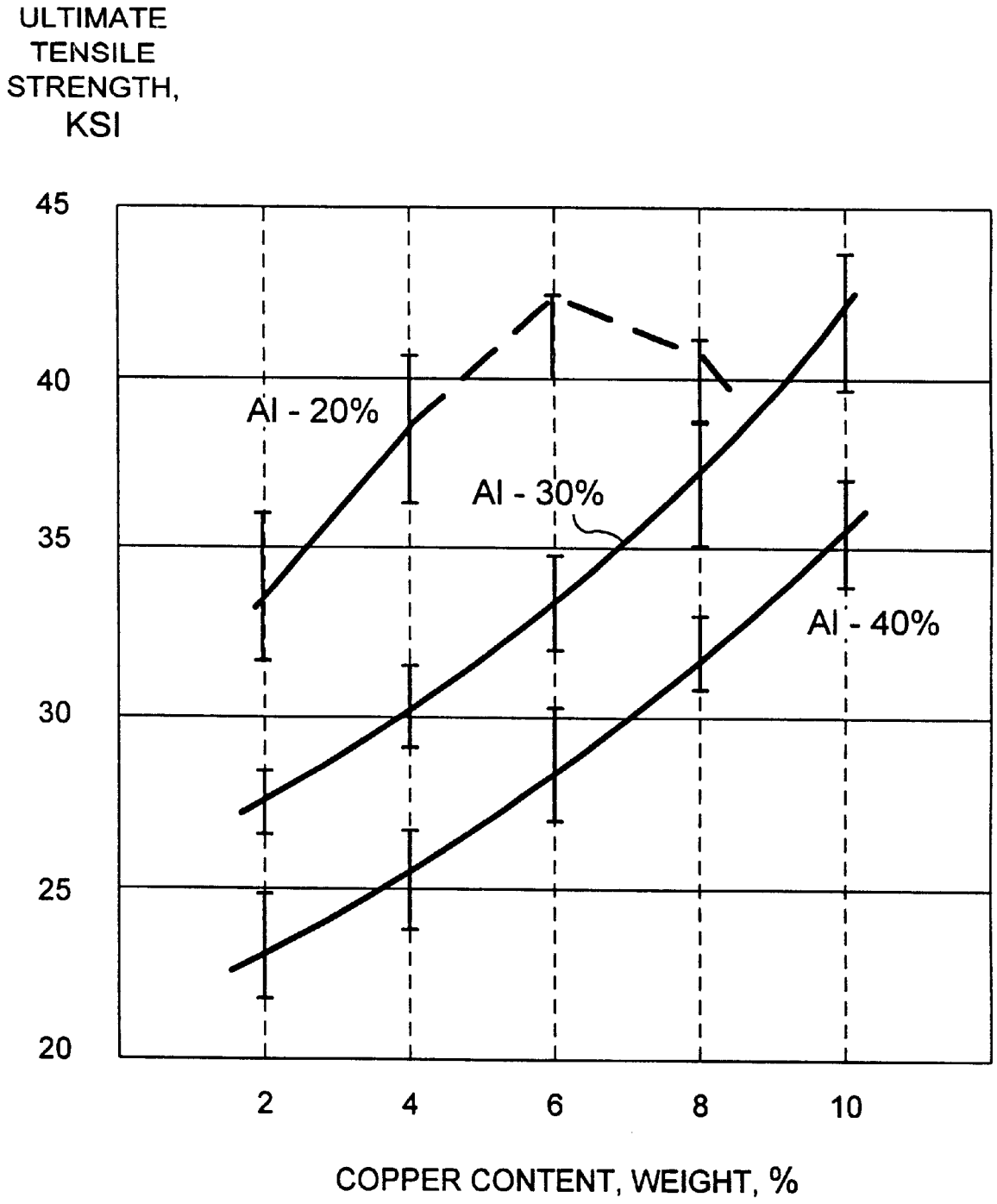
FIG. 9 is a graph illustrating a relationship between ultimate tensile strength (KSI) of the Be-(20–40)Al alloy and. its copper content (wt. %)
Figure 10:
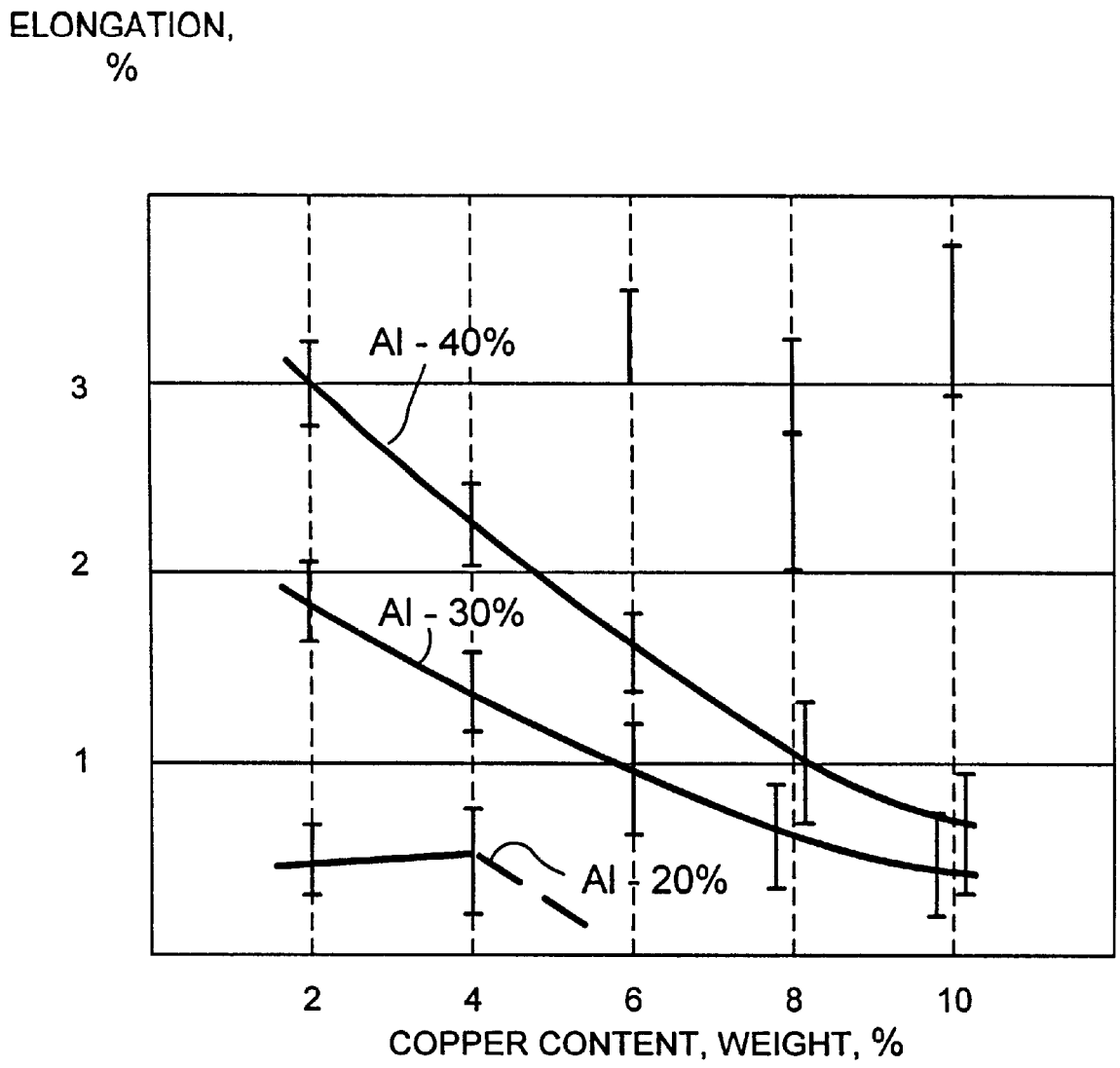
FIG. 10 is a graph which illustrates a relationship between elongation of the Be-(20–40)Al alloy and its Cu content (wt. %)

A series of experimental castings were performed with a modified copper concentration, i.e., from about 2.0% to about 10.0%. The specimen tested was a (20–40) aluminum alloy. It was concluded that increased copper content in aluminum-beryllium-copper alloys leads to higher strength and lower elongation, whereas increased aluminum content shows opposite results. The results of mechanical testing are shown in FIGS. 9 and 10. Samples made of alloys with relatively low aluminum (20%) and copper content (6%) exhibited casting defects and failed during testing. Criteria defining maximum mechanical properties are shown in the diagram.

Although the processes illustrated herein are applied to Be—Al—Ni or Be—Al—Cu alloys containing magnesium, it is understood that analogous processes could be practiced on alloying additions such as silver, iron, cobalt, silicon, titanium, zirconium, or other elements, within the spirit and scope of the present invention.

Overall, magnesium may be added to aluminum-beryllium alloys in a variety of ways, including addition to the initial charge, placement on the foil or the charge, melting separately and then adding to the melt, through plunging a solid into the melt, or pouring the melt over or into a tundish containing a desired magnesium content prior to filling the mold. Preferably, magnesium is added by placing or pouring a molten magnesium master alloy onto a molten aluminum-beryllium alloy, or by running magnesium ribbon/wire or magnesium master alloy ribbon/wire into the melt. In each case, either pure magnesium or a magnesium master alloy, such as a 50—50 magnesium-aluminum alloy, may serve as an acceptable source of magnesium, though modifications may be warranted in input charge chemistry where a master alloy is used.

Aluminum-beryllium is a principle alloy to which additions of ternary magnesium and higher order elements are made. Alloys of the present invention are made by measuring out the required elements, melting according to various methods as presented herein, and adding magnesium accordingly. Additions of elements labeled "Z" may be made anytime before the addition of magnesium.

A magnesium to silicon ratio of 2:1 by weight is considered optimum for mechanical strength. Silicon contents may be increased above the ideal ratio to improve Fluidity and castability. It is noted that silicon additions up to about 6% are possible, provided the total of nickel, cobalt, copper, zinc and iron remains below about 2%. Additions of about 0.2% strontium or other silicon modifier are considered relatively important to alloy performance.

Overall, the present invention is advantageous in facilitating investment casting of high strength aluminum-beryllium alloys containing magnesium. The resulting alloy has low x-ray cross-section and good corrosion resistance. In addition, replacement of silver by magnesium, as an additive, eliminates environmental and other water pollution concerns during processing and recycling. The present invention further provides the feature of adding magnesium to the melt just before casting and after vacuum refining. This is done to reduce magnesium loss due to boiling and vaporization. Pressurization is also used to reduce magnesium loss.

Figure 11:
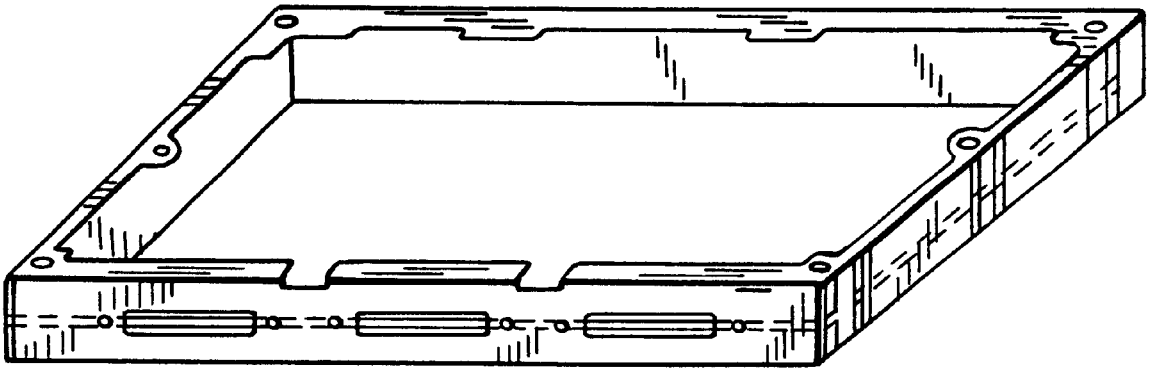
FIG. 11 shows an avionics box according to one aspect of the present invention.

Turning now to FIGS. 13–20,alloys of the present invention have found a variety of commercial applications. In accordance with one aspect of the present invention, an avionics box is formed of the alloys, as illustrated in FIG. 11, preferably by investment casting. This box has characteristics desirable for modern aircraft, including high stiffness, good mechanical support, low weight and excellent heat removal characteristics, with a coefficient of thermal expansion low enough to ensure stability during temperature cycling.

Figure 12:
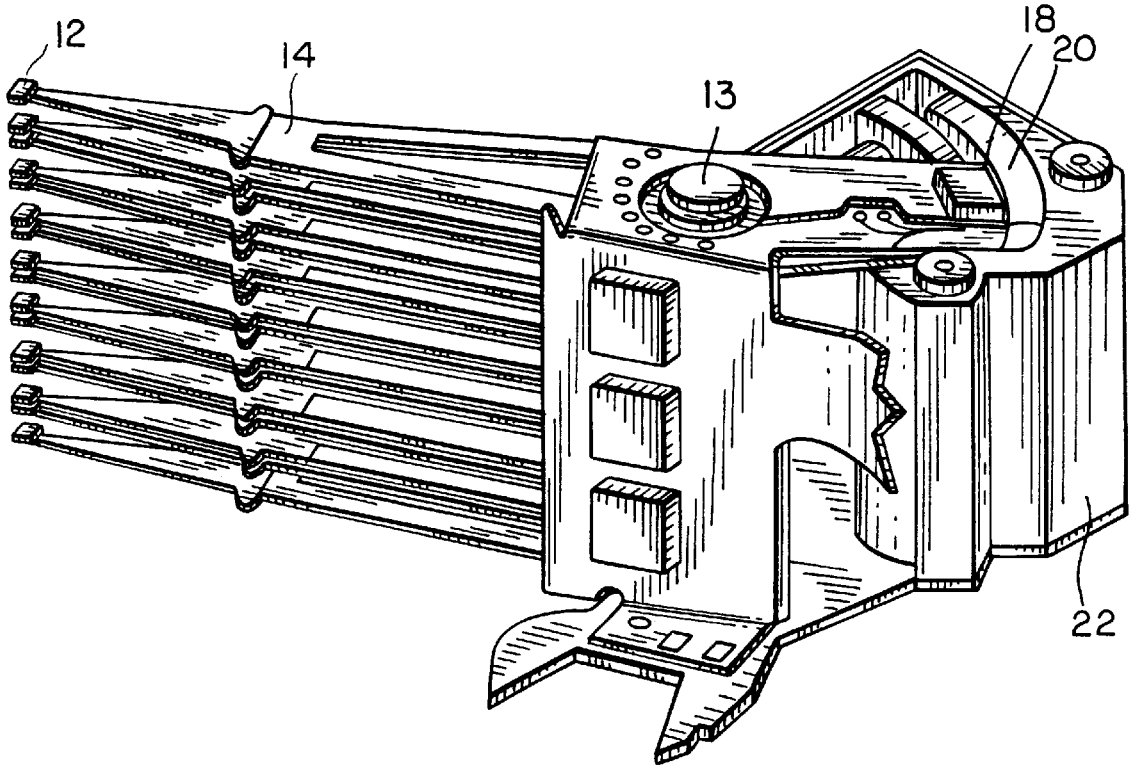
FIG. 12 shows an actuator armset for a computer disk drive according to one aspect of the present invention.
Figure 13:
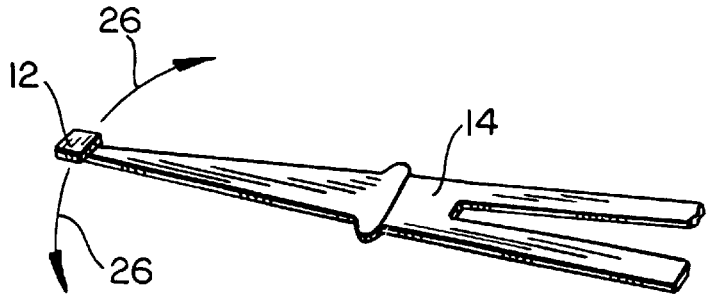
FIG. 13 shows a single actuator arm from the disk drive of FIG. 12. Forces exerted on the arm are represented by vectors.
Figure 14:
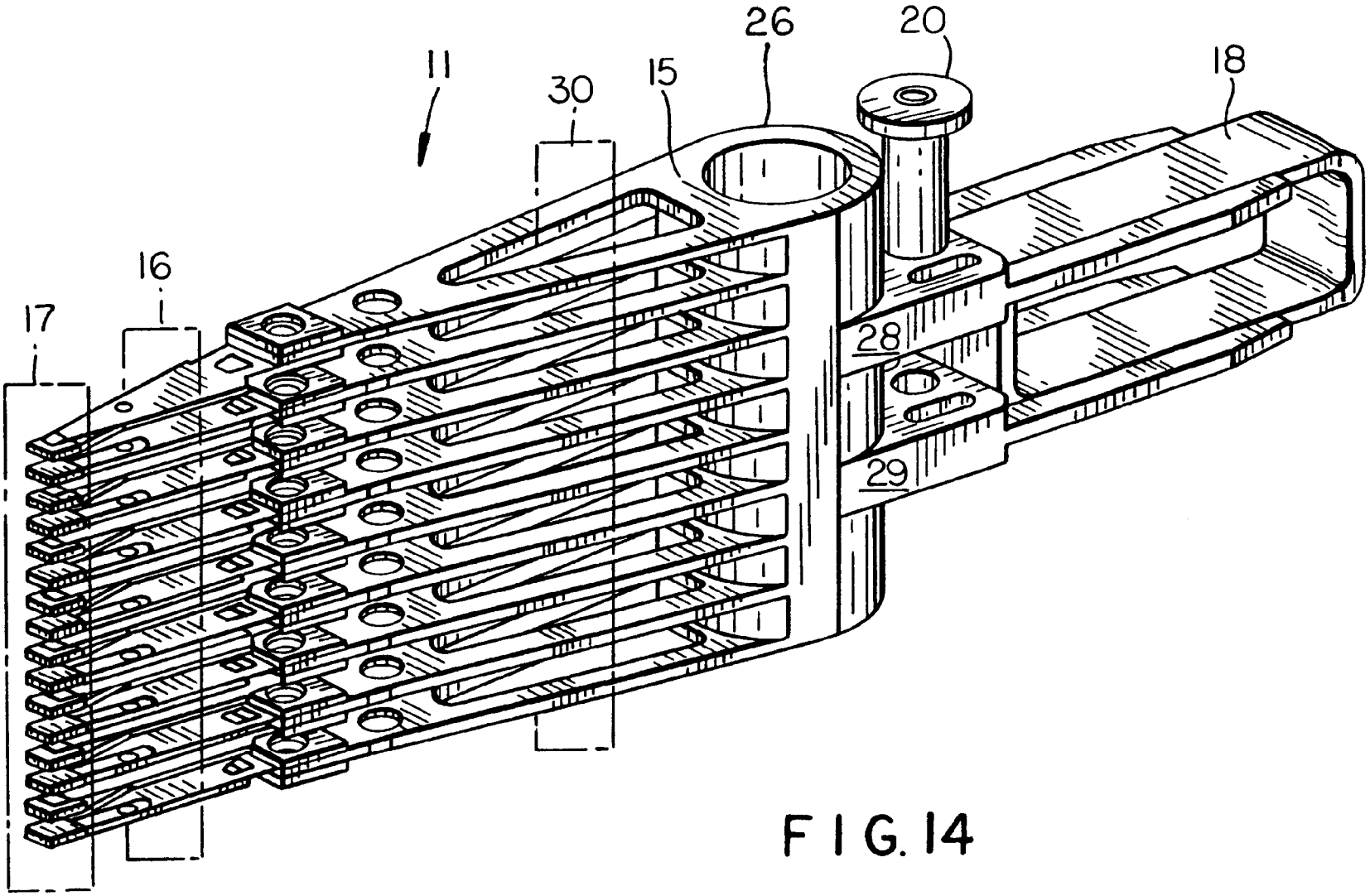
FIG. 14 shows an actuator armset for a computer disk drive according to another aspect of the present invention.

According to another aspect of the present invention there is provided an actuator armset constructed of a high strength cast aluminum-beryllium alloy containing magnesium. As shown in FIGS. 12–14,a rotatable armset of an actuator has a bore for rotating about the shaft of a disk drive for positioning a head radially across a disk. The armset is a one piece unit consisting essentially of an alloy of aluminum containing from about 1 to 99 weight percent beryllium and about 0.1 to 1.25 weight percent magnesium made preferably by investment casting.

More particularly, FIG. 12 illustrates a readwrite assembly for a hard disk drive having multiple heads 12 mounted on actuator arms 14. Heads 12 and actuator arms 14 are assembled together on actuator shaft 13 which is rotated by the interaction of wire coil 18 and magnet 20 disposed in magnet housing 22. Actuator arms 14 are spring loaded to rest on the disk when it is stationary. When the disk is rotated, air pressure develops beneath head 12 and lifts it slightly above the disk.

Actuator arms 14 are subjected to vertical forces 24 and angular forces 26 as shown in FIG. 13. Actuator arms 14 should be sufficiently stiff to minimize the amplitude of vertical vibration and avoid damaging the disks above and below actuator arms 14. Likewise, actuator arms 14 should be sufficiently stiff to minimize the amplitude of lateral vibration and provide a more rapid response time for reading or writing at an appropriate address on the disk. Laminated materials are effective in minimizing deflections principally in the vertical direction. The aluminum-beryllium alloy containing magnesium according to the present invention is effective to minimize deflections in both the vertical and lateral directions. Shown in FIG. 14 is an actuator armset according to another aspect of the present invention. Actuator 11 includes an armset 15, a plurality of suspensions 16, a plurality of transducers 17, a voice coil 18, and crash stop 20. Armset 15 includes a body 26. The body mounts brackets 28 and 29 which hold the voice coil 18 and a plurality of arms 30 positioned above and below each hard disk of disk drive assembly.

Armset structures of these general configurations are shown, for example, in U.S. Pat. No. 5,578,146, issued Nov. 26, 1996, and in U.S. Pat. No. 5,475,549, issued Dec. 12, 1995. The disclosures of both patents are hereby incorporated by reference in their entireties.

Figure 15A:
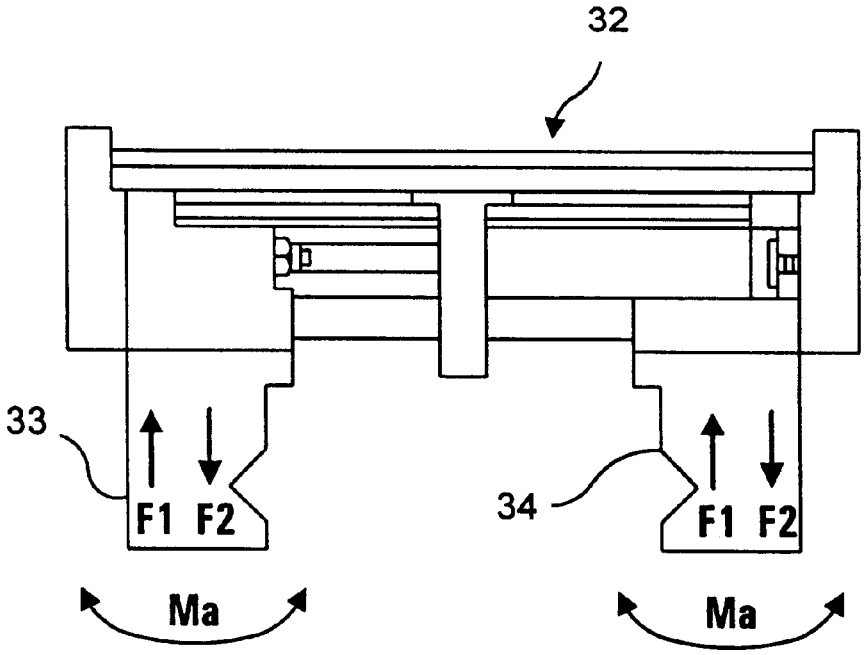
FIG. 15 shows an end effector for a robot arm according to one aspect of the present invention.
Figure 15B:
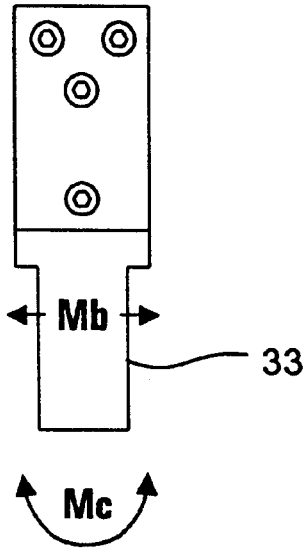

Referring now to robotic applications, there is illustrated generally an end effector 32 for a robot arm in accordance with one embodiment of the present invention. As shown in FIGS. 15*a*–15*b*, jaws 33 and 34 are constructed, at least in part, of a high strength cast aluminum-beryllium alloy containing magnesium according to the present invention. End effectors serve a variety functions including not only holding objects and/or materials during rapid, i.e., high velocity, operations, but also high precision/locating tasks.

Figure 16:
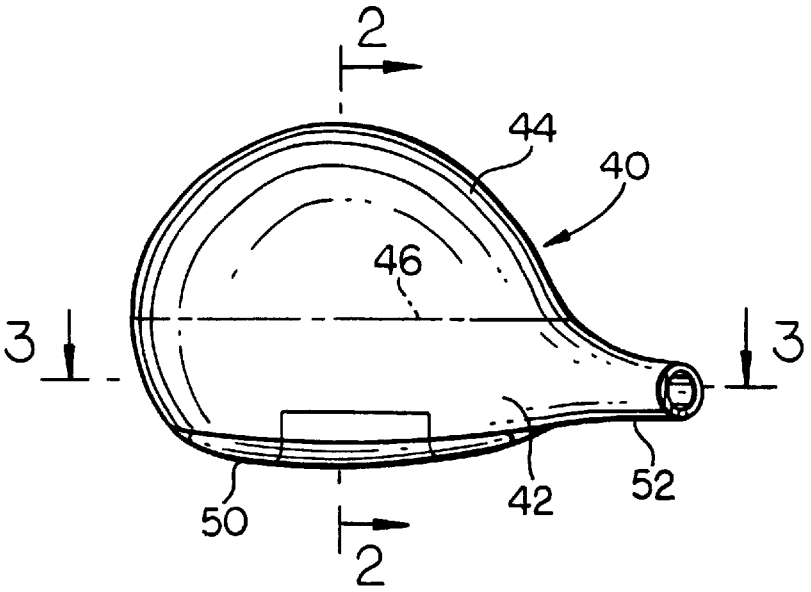
FIG. 16 is a plan view of a metal wood golf club head in accordance with one aspect of the present invention.
Figure 17:
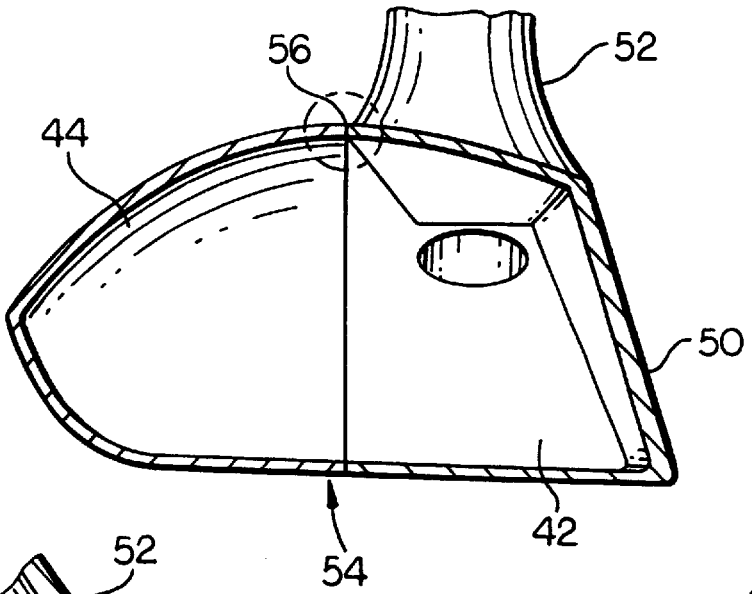
FIG. 17 is a sectional view taken along line 2—2 of FIG. 16.
Figure 18:
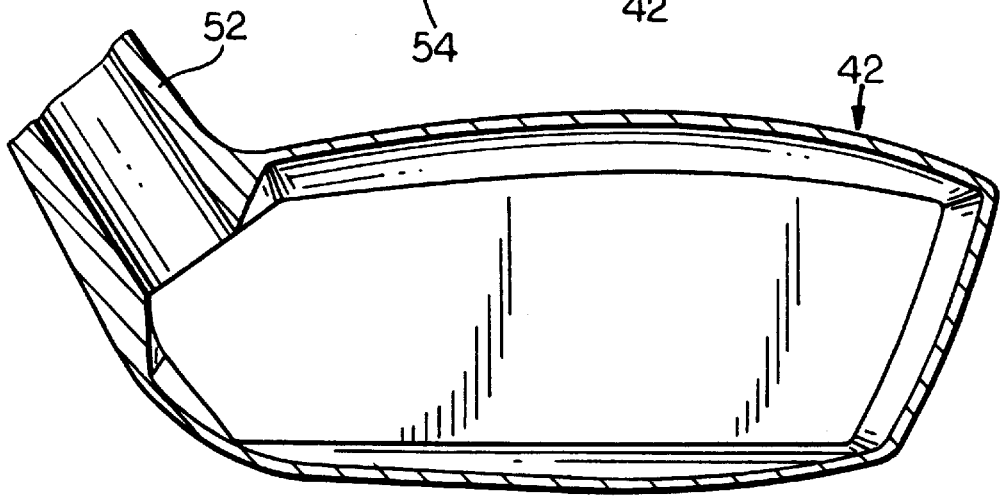
FIG. 18 is a sectional view taken along line 3—3 of FIG. 16.

In accordance with other embodiments of the present invention is a golf club head constructed in whole or in part of a high strength cast aluminum-beryllium alloy containing magnesium of the present invention. As shown in FIGS. 16–18, a golf metal wood driver 40 is fabricated from two cast half sections 42 and 44, joined together along a seam 46 which extends generally parallel to the club face 50 and behind hosel 52. The two half sections, when joined, define a hollow metal wood club with face region 50, hosel 52, sole region 54, and crown 56.

Figure 19:
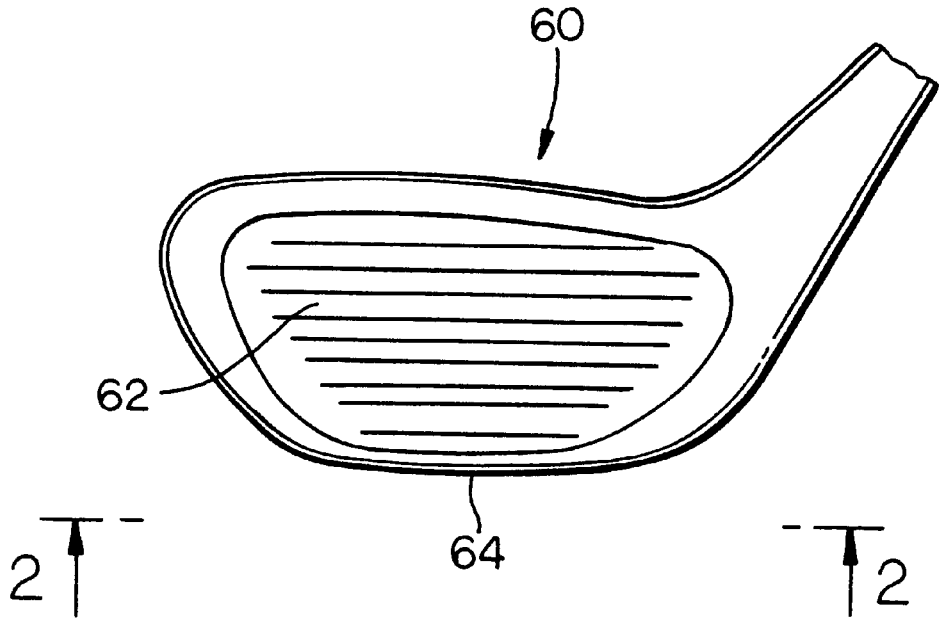
FIG. 19 shows a golf club head in accordance with another aspect of the present invention.
Figure 20:
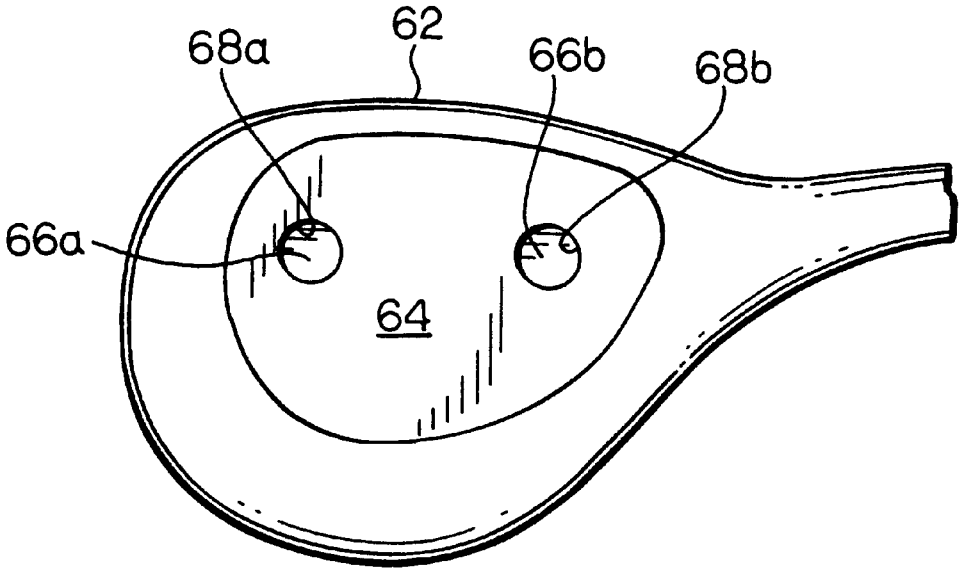
FIG. 20 is a bottom view of the golf club head show in FIG. 19.

Illustrated in FIGS. 19 and 20 is a golf club head 60 constructed in whole or in part of a high strength cast aluminum-beryllium alloy containing magnesium according to the present invention. The head has a front wall 62 and a bottom wall 64. The bottom wall includes a plurality of threaded inserts 66*a,b* received in counterbores 68*a,b*. The inserts are constructed of a relatively heavier material such as a copper alloy or steel.

Methods of manufacturing golf club heads, according to the present invention, are described, for example, in U.S. Pat. No. 5,167,733, issued on Dec. 1, 1992, the disclosure of which is hereby incorporated by reference in its entirety.

While alloys of the present invention are shown and described with reference to avionics boxes, actuator armsets, end effectors, and golf clubs, they have been found suitable for other applications including pistons for automobile engines and brake calipers, such applications being considered within the spirit and scope of the present invention.

Various modifications and alterations to the present invention may be appreciated based on a review of this disclosure. These changes and additions are intended to be within the scope and spirit of this invention as defined by the following claims.

What is claimed is:

1. A method of producing a high strength cast aluminum-beryllium alloy containing magnesium which comprises the steps of:

(i) melting charges of aluminum-beryllium under vacuum;

(ii) increasing the gas pressure exerted on the melt of step i with an inert gas;

(iii) adding magnesium to the melt of step ii under a selected pressure to retard boiling;

(iv) casting the melt of step (iii) under a selected pressure; and (v) cooling the melt of step iv under in an inert gas atmosphere.

2. The method set forth in claim 1 wherein step v comprises cooling the melt of step iv under a selected pressure.

3. The method of claim 1, wherein magnesium is added to the melt of step (ii) under a pressure of about 1 atmosphere.

4. The method of claim 1, wherein the alloy contains about 25 to 60% Al, about 40 to 75% Be and about 0.1 to 1.25% Mg.

5. The method of claim 4, wherein the alloy contains at least one of Ni, Co and Cu in an amount of up to 5%.

6. The method of claim 5, wherein the alloy contains at least one of Si and Ag in an amount of up to 4%.

7. The method of claim 5, wherein the alloy contains at least one of Fe, Ti Zr, B, Sb, Sr, Ge, Sc and a Rare Earth Element in an amount of up to 0.75%.

8. The method of claim 4, wherein the alloy has a first phase formed by a primary solid solution based on the Be—β-phase with a microhardness $H_\mu$ of about 285 KSI, a second phase formed by a solid solution based on the Al—α-phase with a microhardness $H_\mu$ of about 85 KSI and a phase of unknown nature having a microhardness $H_\mu$ of about 714 KSI.

9. The method of claim 1, wherein the melt is cast under a pressure of about 180 psi.

10. The method of claim 1, wherein the alloy contains at least one of Si and Ag in an amount of up to 4%.

11. The method of claim 1, wherein the alloy contains at least one of Fe, Ti Zr, B, Sb, Sr, Ge, Sc and a Rare Earth Element in an amount of up to 0.75%.

12. A method for producing a high strength cast aluminum-beryllium alloy containing magnesium which comprises:

(a) forming a molten mass of beryllium-aluminum having a solidified surface, (b) placing an aluminum-magnesium master alloy on the solidified surface, and (c) heating the beryllium-aluminum mass and the aluminum-magnesium master alloy to melt the master alloy thereby allowing the master alloy and the beryllium-aluminum mass to mix together.

13. The method of claim 12, wherein mixing of the master alloy and the beryllium-aluminum mass together is accomplished under an inert atmosphere.

14. The method of claim 13, wherein charges of aluminum and beryllium are heated under a vacuum to form the molten mass of beryllium-aluminum, and further wherein the molten mass of beryllium-aluminum is cooled to form the solidified surface.

15. A high strength cast aluminum-beryllium alloy consisting essentially of 25 to 60% Al, 40 to 75% Be, greater than zero to 5% Ni and 0.1 to 1.25% Mg, 0 to 4% Ag, 0 to 0.75% Fe, Ti, Zr, B, Sb, Sr, Ge Sc and/or a rare earth metal, and incidental impurities, the alloy having a first phase formed from a primary solid solution based on the Be—β-phase with a microhardness $H_\mu$ of about 285 KSI, a second phase formed by a solid solution based on the Al—α-phase with a microhardness $H_\mu$ of about 85 KSI and a phase of unknown nature having a microhardness $H_\mu$ of about 714 KSI.

16. The alloy of claim 15, wherein the alloy contains at least one of Co and Cu, wherein the total amount of Ni, Co and Cu in the alloy is up to 5%.

17. The alloy of claim 15, wherein the alloy contains Ag in an amount of up to 4%.

18. The alloy of claim 15, wherein the alloy contains at least one of Fe, Ti Zr, B, Sb, Sr, Ge, Sc and a Rare Earth Element in an amount of up to 0.75%.

19. The alloy of claim 15, wherein the alloy is made by:

(i) melting charges of aluminum-beryllium under vacuum, (ii) increasing the gas pressure exerted on the melt of step (i) with an inert gas, (iii) adding magnesium to the melt of step (ii) under a selected pressure to retard boiling, (iv) casting the melt of step (iii) under a selected pressure, and (v) cooling the melt of step (iv) under an inert gas atmosphere.

20. The alloy of claim 19 in the form of a shaped product selected from the group consisting of an avionics box, a rotatable armset of an actuator, an end effector for a robot arm and a piston.

21. The alloy of claim 15 in the form of a shaped product selected from the group consisting of an avionics box, a rotatable armset of an actuator, an end effector for a robot arm and a piston.

22. A method for reducing loss of magnesium from a molten metal mass of aluminum, beryllium and magnesium, the molten mass being formed at least partially by melting charges of aluminum and beryllium under vacuum, the process comprising raising the pressure on the molten mass so as to reduce boiling of the magnesium therein.

23. The method of claim 22, wherein the molten metal mass is in contact with a gaseous atmosphere, and further wherein the pressure on the molten mass is raised by increasing the pressure of an inert gas in the gaseous atmosphere.

24. The method of claim 23, further comprising pouring the molten mass into a mold under a pressure above atmospheric.

25. The method of claim 24, wherein the mold is under a pressure of about 180 psi.

26. An aluminum-beryllium-copper eutectic class alloy consisting essentially of 20 to 40% Al, 60 to 70% Be, 2 to 10% Cu, 0.1 to 1.25% Mg, 0 to 4% Ag, 0 to 0.75% Fe, Ti, Zr, B, Sb, Sr, Ge Sc and/or a rare earth metal, and incidental impurities, the alloy structure being characterized by the presence of a Be phase (β-phase) and a degenerated eutectic consisting of a solid solution of beryllium in aluminum.

27. An aluminum-beryllium-nickel eutectic class alloy consisting essentially of 25 to 60% Al, 40 to 75% Be, 0.1 to 1.25% Mg greater than zero to 5% Ni, 0 to 4% Ag, 0 to 0.75% Fe, Ti, Zr, B, Sb, Sr, Ge Sc and/or a rare earth metal, and incidental impurities, the alloy structure being characterized by the presence of a Be phase (β-phase) and a degenerated eutectic consisting of a solid solution of beryllium in aluminum.

28. A high strength cast aluminum-beryllium alloy containing magnesium, the alloy consisting essentially of 25 to 60% Al, 0.1 to 1.25% Mg, 0 to 10% Ni, Co and/or Cu, 0 to 4% Ag, and 0 to 0.75% Fe, Ti, Zr, B, Sb, Sr, Ge Sc and/or a rare earth metal, with the balance being 40 to 75% Be and incidental impurities.

29. The alloy of claim 28, wherein the alloy consists of 25 to 60% Al, 0.1 to 1.25% Mg, 0 to 10% Ni, Co and/or Cu, 0 to 4% Ag, and 0 to 0.75% Fe, Ti, Zr, B, Sb, Sr, Ge Sc and/or a rare earth metal, with the balance being 40 to 75% Be and incidental impurities.

30. The alloy of claim 29, wherein the alloy contains 2 to 10% Cu.

31. The alloy of claim 29, wherein the alloy contains greater than zero to 5% Ni.

32. The alloy of claim 28, wherein the alloy contains 2 to 10% Cu.

33. The alloy of claim 28, wherein the alloy contains greater than zero to 5% Ni.

* * * * *